US006142408A

United States Patent [19]

Focke et al.

[11] Patent Number: 6,142,408

[45] Date of Patent: Nov. 7, 2000

[54] PROCESS AND APPARATUS FOR CONNECTING MATERIAL WEBS

[75] Inventors: Heinz Focke, Verden; Jens Renken, Dohren; Harald Freudenberg, Marklohe, all of Germany

[73] Assignee: Focke & Co., Verden, Germany

[21] Appl. No.: 09/245,708

[22] Filed: Feb. 8, 1999

[30] Foreign Application Priority Data

Feb. 6, 1998 [DE] Germany ..... 198 04 614

[51] Int. Cl.[7] ..... B65H 19/18; B65H 19/20

[52] U.S. Cl. ..... 242/553; 242/556; 242/556.1; 242/562.1; 156/159; 156/506

[58] Field of Search ..... 242/552, 553, 242/554.3, 556, 556.1, 562, 562.1; 156/159, 256, 504, 505, 506

[56] References Cited

U.S. PATENT DOCUMENTS

| | | | |
|---|---|---|---|
| 3,769,124 | 10/1973 | Johnson | 156/159 |
| 3,841,944 | 10/1974 | Harris, Jr. . | |
| 4,120,739 | 10/1978 | Peeters et al. | 156/506 |
| 4,455,190 | 6/1984 | Bianchetto et al. | 242/552 |
| 4,579,293 | 4/1986 | Steiniger | 242/556.1 |
| 4,821,971 | 4/1989 | Watanabe et al. | 242/562.1 |
| 4,848,691 | 7/1989 | Muto et al. | 242/553 |
| 4,878,986 | 11/1989 | Nishikawa | 156/504 |
| 4,984,750 | 1/1991 | Shigeta et al. | 242/553 |
| 5,397,424 | 3/1995 | Sakano et al. . | |
| 5,468,321 | 11/1995 | Van Liempt | 242/553 |
| 5,487,805 | 1/1996 | Boriani et al. | 242/552 |
| 5,518,202 | 5/1996 | Focke et al. | 242/552 |
| 5,935,361 | 8/1999 | Takahashi et al. | 242/553 |

FOREIGN PATENT DOCUMENTS

| | | |
|---|---|---|
| 29 38 685 | 6/1980 | Germany . |
| 36 14 221 | 10/1987 | Germany . |
| 37 26 139 | 2/1989 | Germany . |
| 26 52 411 | 4/1989 | Germany . |
| 42 19 910 | 12/1992 | Germany . |
| 42 12 095 | 8/1993 | Germany . |
| 34 41 205 | 4/1994 | Germany . |
| 43 25 944 | 2/1995 | Germany . |

*Primary Examiner*—John M. Jillions
*Attorney, Agent, or Firm*—Sughrue, Mion, Zinn, Macpeak & Seas, PLLC

[57] ABSTRACT

Process and apparatus for connecting material webs, namely one end of a new web (34) to one end of a runoff web (58).

The new web (34), on the one hand, and run-off web (29), on the other hand, are each gripped individually, and stopped, by clamping parts (49, 50; 51, 52). The run-off web (29) and new web (34) are then severed. The fixed web ends—run-off end (58) and new, initial portion (59)—are positioned in a common plane by the clamping parts (49, 50; 51, 52) and connected to one another by a tape (60).

22 Claims, 19 Drawing Sheets

PROCESS AND APPARATUS FOR CONNECTING MATERIAL WEBS

BACKGROUND OF THE INVENTION

The invention relates to a process for connecting material webs made of packaging material or the like, namely a run-off end of a run-off web to a new, initial portion of a new web which is to be connected, by connecting means, in particular adhesive strips, it being the case that the new web and the run-off web are gripped by clamping means and severed, and the resulting run-off end, on the one hand, and new, initial portion, on the other hand, are connected to one another. The invention also relates to an apparatus for carrying out the process.

Packaging machines frequently process web-like packaging material for the purpose of producing blanks. High-output packaging machines, e.g. cigarette-packaging machines, use up a lot of packaging material. For the purpose of connecting a material web from a new, full reel—new web—to a material web running off from a reel which has almost run out—run-off web—automatically operating connecting assemblies which connect the new web to the run-off web without manual intervention are known. In the case of one known connecting assembly (EP 0 638 499), a free end of the new web is drawn off from the full reel and fed to a connecting assembly. In the region of the latter, the run-off web and the new web are pressed against one another by clamping elements and severed. The resulting new, initial portion and the run-off end are connected to one another by an adhesive strip (tape).

SUMMARY OF THE INVENTION

The object of the invention is to improve the measures for automatically connecting a new web to a run-off web, in particular to increase the output capacity and reliability. In order to achieve this object, the process according to the invention is characterized in that the run-off web, on the one hand, and the new web, on the other hand, are each gripped individually in a clamping manner and in each case an end part and an initial part are severed from the run-off web and from the new web, respectively, and in that the resulting run-off end and the new, initial portion are connected to one another.

The separate preparation of the run-off web, on the one hand, and of the new web, on the other hand, by virtue of web sections being severed increases the operating speed and the reliability. In this case, use is made of clamping or retaining elements which bring the resulting ends, namely run-off end and new, initial portion, into a position directly one beside the other, with the result that a connecting means, that is to say an adhesive strip, adhesive label or an adhesive, can be provided in the region of a web overlap.

The initial part of the new web is formed in a particular way. A continuous outer layer of the new web wound on the new reel is severed in the axis-parallel direction—transversely with respect to the material web—to be precise such that an initial part of the new web hangs down freely in leg form. This free initial part is gripped by a web-retaining means and drawn to the connecting assembly.

The web-retaining means is designed in a particular way, in particular with a gripping element for the purpose of gripping the material web, a fold which is gripped by clamping action being formed in the process. The connecting assembly is also a special feature.

The way in which the apparatus functions is set up such that the end part which has been severed from the run-off web, as well as the initial part which has been severed from the new web, are disposed of automatically. It is also provided that a reel core, which becomes free once a reel has been used up, is likewise disposed of.

Further details of the invention relate to the process and apparatus for handling the new reel and the new web and to the configuration and functioning of the connecting assembly.

BRIEF DESCRIPTION OF THE DRAWINGS

Details of the process and of the apparatus are explained in more detail hereinbelow with reference to the drawings, in which.

DESCRIPTION OF PREFERRED EMBODIMENTS

Figure 1:
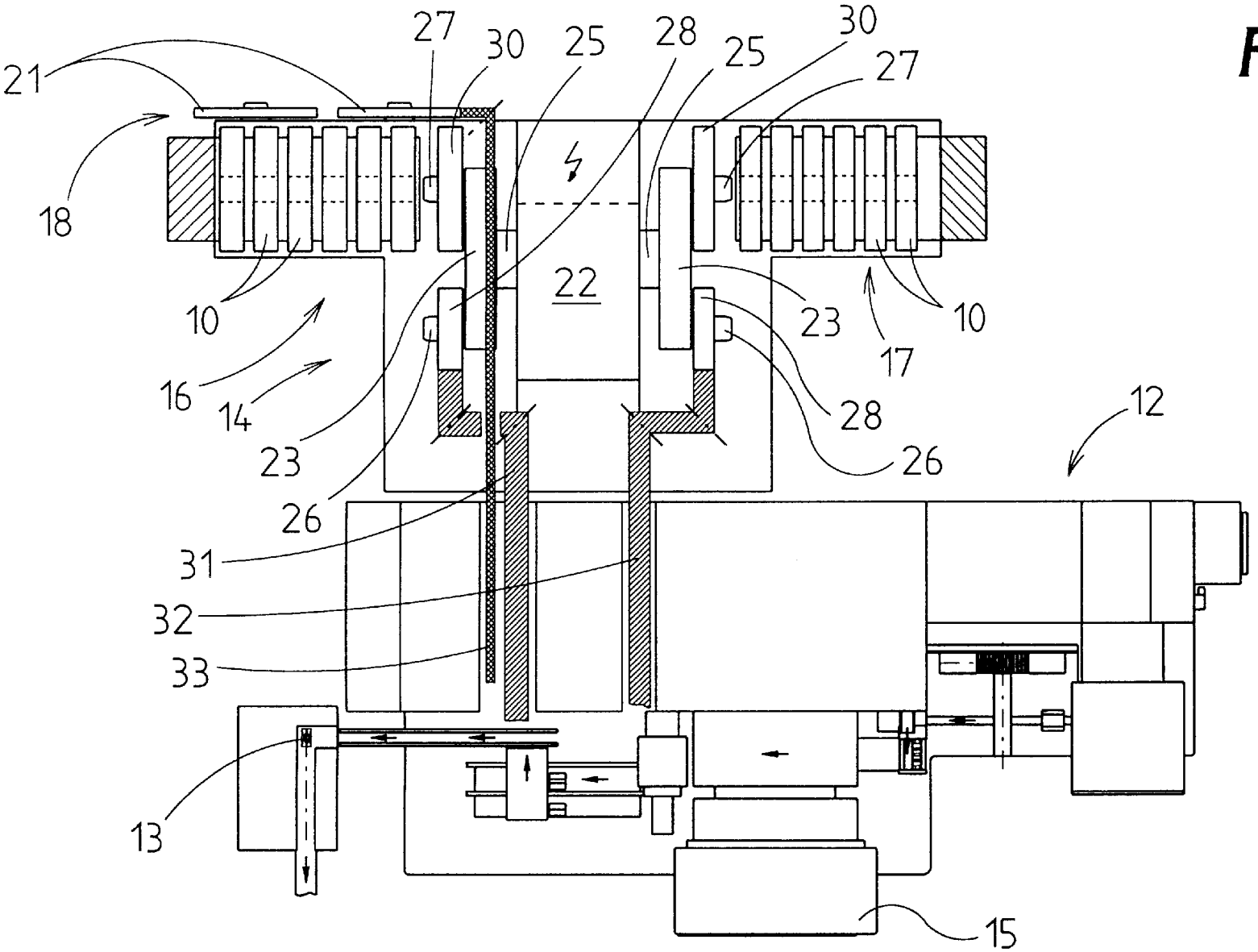
FIG. 1 shows a schematic plan view of a packaging installation, namely packaging machine and material unit.

The details illustrated in the drawings relate to the handling of wound packaging material, that is to say reels 10. The latter may consist of paper, tin foil, film or some other kind of web-like material. The material web is wound on to a reel core 11, which may consist of paperboard or else of plastic or metal.

As an important use example, FIG. 1 shows a plan view of a packaging machine 12. This machine is a soft-carton packer, that is to say a packaging machine 12 for producing cigarette packs 13 of the soft-carton type. The packaging machine 12 is assigned a material unit 14. The latter is arranged on the rear side of the packaging machine 12, namely on the opposite side from a folding turret 15 and other assemblies.

In accordance with the materials which are to be processed, the material unit 14 has two reel magazines 16, 17 with a supply of reels 10 positioned one beside the other in the axial direction. The reel magazine 16 contains, for example, reels 10 of tin foil and the reel magazine 17 contains, for example, reels 10 of paper for producing a carton of the cigarette pack 13. Furthermore, revenue-stamp reels 21 are accommodated in the region of a separate reel supply 18 comprising a comparatively narrow material web for the production of revenue stamps, which are attached, as is known, in the region of end sides of the cigarette packs 13.

In the region of the reel magazine 16, 17, the reels 10 are spaced apart from one another in the axial direction. A respectively front reel 10 is removed from the reel magazine 16, 17 and transferred directly to a carrying device, namely to a rotatable stub which passes into a central opening of the reel 10, said opening being formed by the reel core 11. The material web is drawn off from the reel 10 by virtue of the stub being rotated.

The material unit 14 is arranged such that the larger reel magazines 16, 17 are arranged on opposite sides of a central operating unit 22. The latter comprises a housing for receiving drive elements and control means. Arranged on opposite longitudinal sides of the operating unit 22 is in each case one carrying device for reels 10 and/or stubs for receiving reels 10, to be precise a reel arm 23, 24 as a two-armed lever with a central rotary bearing 25. Arranged at the ends of the reel arm 23, 24 in each case is a carrying stub for a reel 10, namely an operating stub 26 and a supply stub 27. The stubs 26, 27 are mounted on the reel arm 23, 24 in a freely projecting manner. The stub which is directed towards the packaging machine 12 is the operating stub 26. The latter bears a run-off reel 28, from which the material web, namely a run-off web 29, is drawn off. The supply stub 27, which is directed towards the reel magazine 16, 17, serves for receiving a new, complete replacement reel or new reel 30. The supply stub 27 can be moved, by virtue of the reel arm 23, 24 being rotated, into a position aligned with the reel cores 11 of the reel magazine 16, 17, with the result that following reels 10 can be pushed directly on to the supply stub 27. It is possible in this case, as is indicated schematically, to raise the relevant reel 10 or the new reel 30 for transfer to the supply stub 27.

Three material webs, namely a tin-foil web 31, a paper web 32 and a revenue-stamp web 33, are fed to the packaging machine 12 in the present case. The aforementioned webs 31, 32, 33 are deflected a number of times, with the result that they are fed to the packaging machine 12 in a position which is favorable for processing.

The revenue-stamp reels 21 are arranged on the common material unit 14, to be precise in the region of the reel magazine 16, transversely with respect to the axis thereof. Carrying stubs are also provided for the revenue-stamp reels 21, namely operating stubs 26 and supply stubs 27 in this case too.

Before the run-off reel 28 has been used up, the new reel 30 is brought into position, by the reel arm 23, 24 being pivoted, and a new web 34, which has been drawn off from the new reel 30, is connected mechanically to the run-off web 29.

The connection of the new web 34 to the run-off web 29 takes place in a number of steps. First of all, the new reel 30 is prepared by a free, grippable initial portion of the new web 34 being created. Thereafter, a section of the new web, namely an initial part 35, is drawn off from the new reel 30 and connected to the run-off web 29. By virtue of severing, the initial part 35 is severed from the new web 34 and an end part 36 is severed from the run-off web 29. The initial part 35, end part 36 and the reel core 11 remaining on the operating stub 26 are disposed of.

First of all, the initial part 35 of the new reel 30 is freed. The latter is provided with a continuous outer covering, which is usually formed by an outer layer of the new web 34, said outer layer being closed off to give a continuous form by adhesive bonding. This layer has to be severed. For this purpose, the new reel 30 is moved, by virtue of the reel arm 23, 24 being pivoted correspondingly in the anticlockwise direction, into a bottom, processing position, in which the reel arm 23, 24 assumes an obliquely directed position (FIG. 3).

Figure 2:
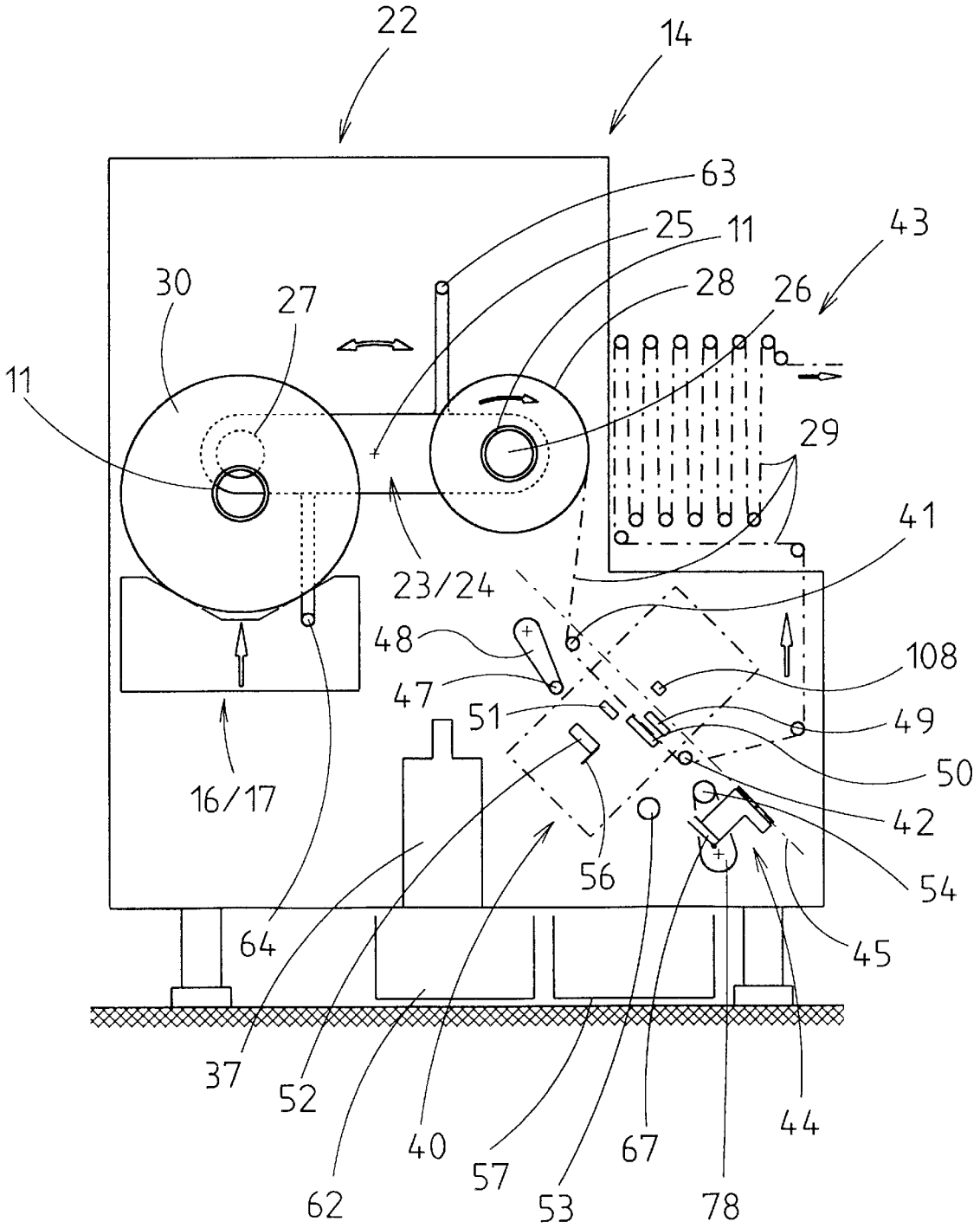
FIG. 2 shows, on an enlarged scale, a schematic side view of the material unit of FIG. 1, FIGS. 3 to 14 show side views of a sequence of operating steps in the connection of a new web to a run-off web, elements and assemblies being illustrated schematically.
Figure 4:
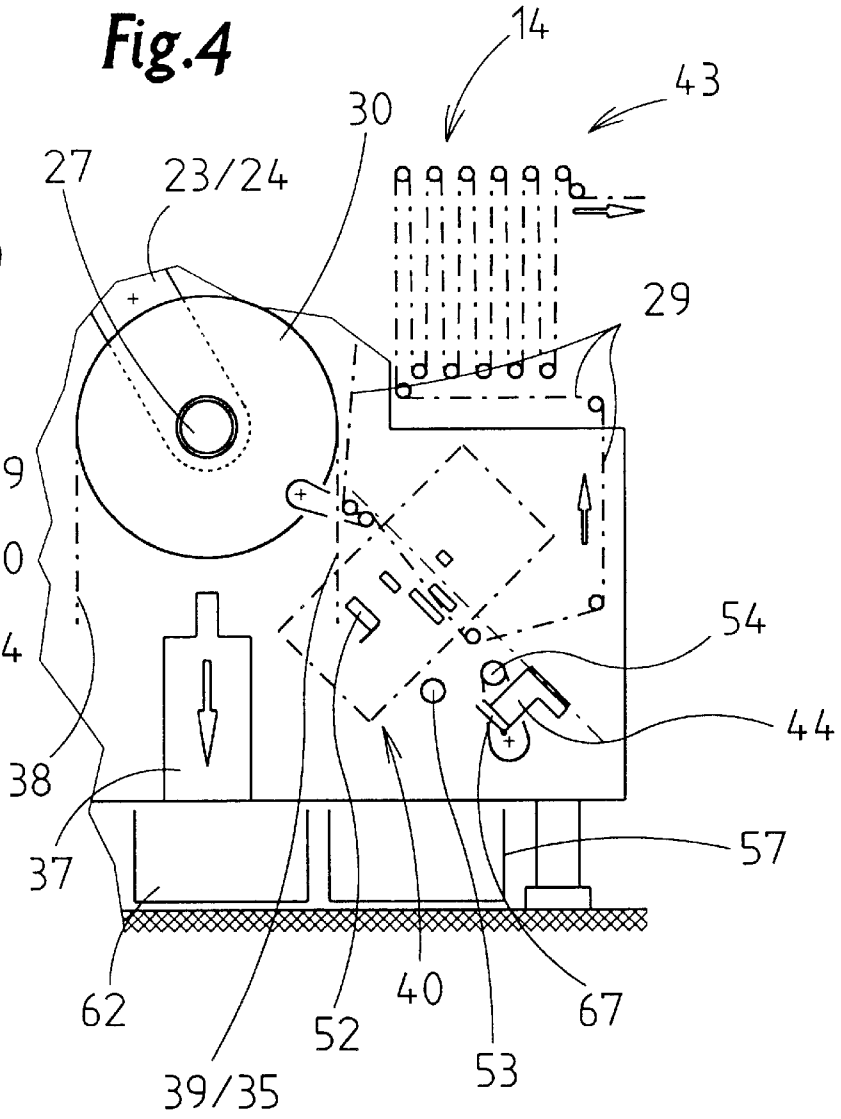
Figure 3:
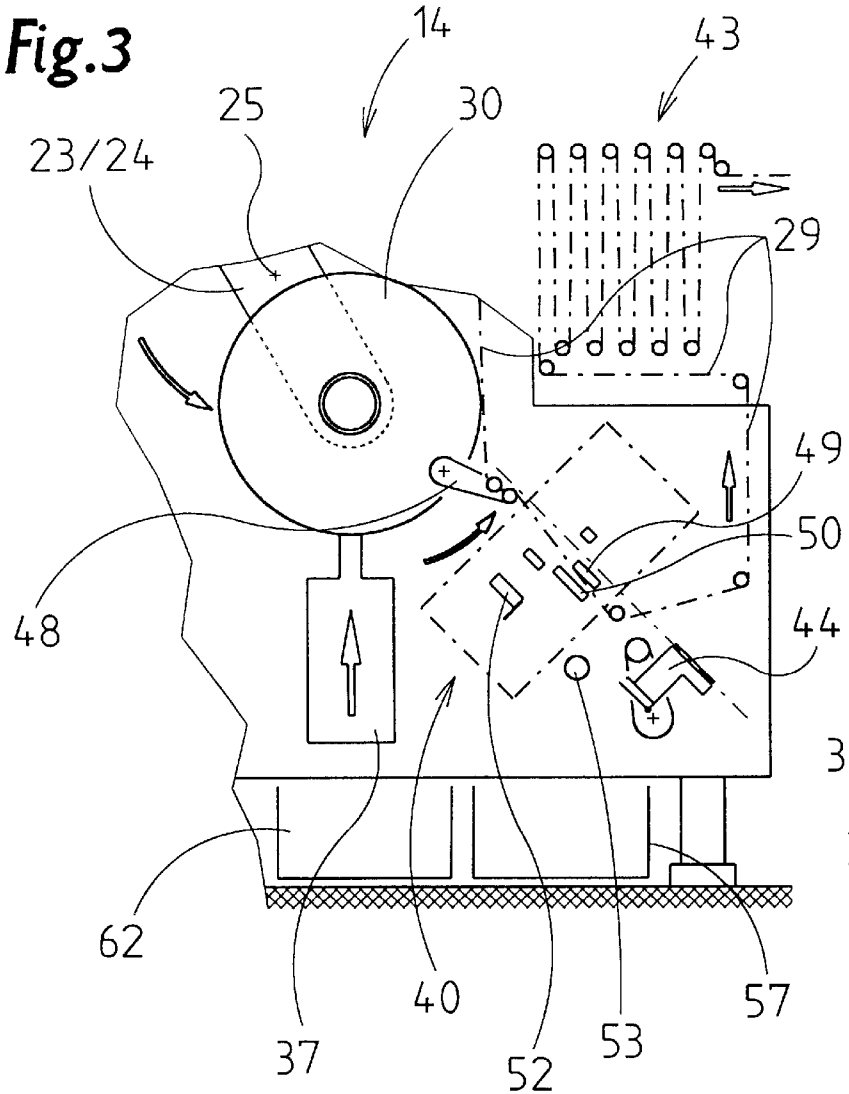

In this position, a severing assembly 37 takes effect, that is to say it is moved upwards out of a bottom, standby position (FIG. 2) until it butts against the circumference of the new reel 30 (FIG. 3). The outer layer of the material web is then severed in the transverse direction. Free web legs 38, 39 are formed in this way (FIG. 4). These legs hang tangentially in vertical planes on opposite sides of the new reel 30. Once the severing cut has been carried out, the severing assembly 37 returns into the bottom, starting position. The severing assembly 37 is preferably designed in accordance with DE 197 10 657.9 and can be moved in the axial direction of the new reel 30. One web leg 39 is part of the initial part 35 of the new web 34. This free region of the new web 34 can be gripped in order for a longer initial part 35 to be drawn off from the new reel 30.

The run-off web 29 and new web 34 are connected in the region of a connecting assembly 40. The latter is arranged in an oblique position in the region of the material unit 14, to be precise for each reel arm 23, 24. The oblique position means that the run-off web 29 and the new web 34 run through the connecting assembly 40 in obliquely downward directed planes.

The apparatus is designed such that the run-off web 29 runs through the connecting assembly 40 during operation. For this purpose, deflecting rollers 41, 42 are arranged in each case on the inlet side and on the outlet side of the connecting assembly 40. During said operating phase, the run-off reel 28 is located above the connecting assembly 40, so as to be laterally offset with respect to the same. The run-off web 29 passing out of the connecting assembly 40 is directed through a web store 43 arranged above the connecting assembly 40. This store has the task of compensating for phases in which the runoff web 29 is at a momentary standstill during the connection of the new web 34. The web store 43 is also located in the region of the material unit 14.

Figure 6:
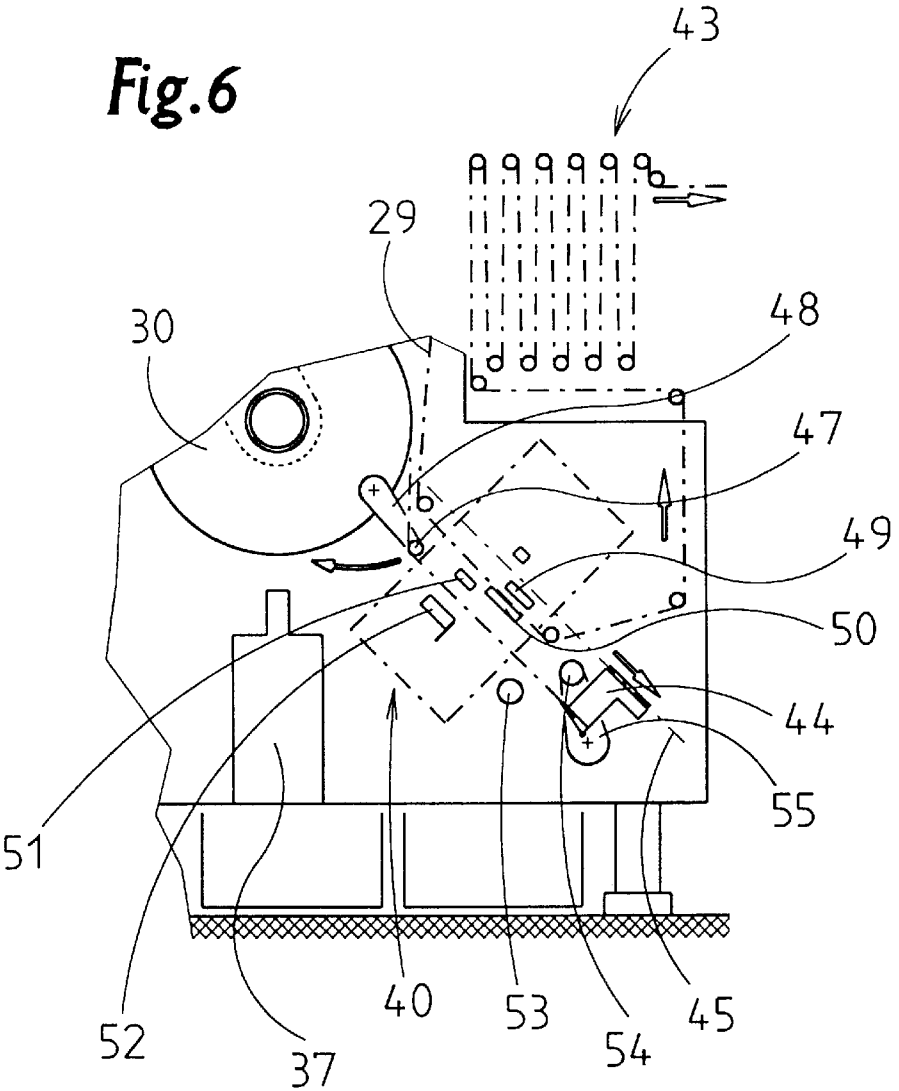

For the purpose of connection to the run-off web 29, the initial part 35 of the new web is drawn through the connecting assembly 40. Provided for this purpose is an element which is designed in a particular way and is intended for gripping and drawing off the initial part 35, namely a web pickup 44. The latter can be moved back and forth in an obliquely directed movement plane 45 running parallel to the plane of the run-off web 29, that is to say it can be moved through the connecting assembly 40 to the new reel 30 and back into a bottom, starting position outside the connecting assembly 40. The web pickup 44 is provided with a special retaining element, namely a gripper 67, for the purpose of gripping the initial part 35 of the new web 34. The latter is drawn through the connecting assembly 40, and retained temporarily by the web pickup 44, in an obliquely downward directed plane (FIG. 6).

Figure 5:
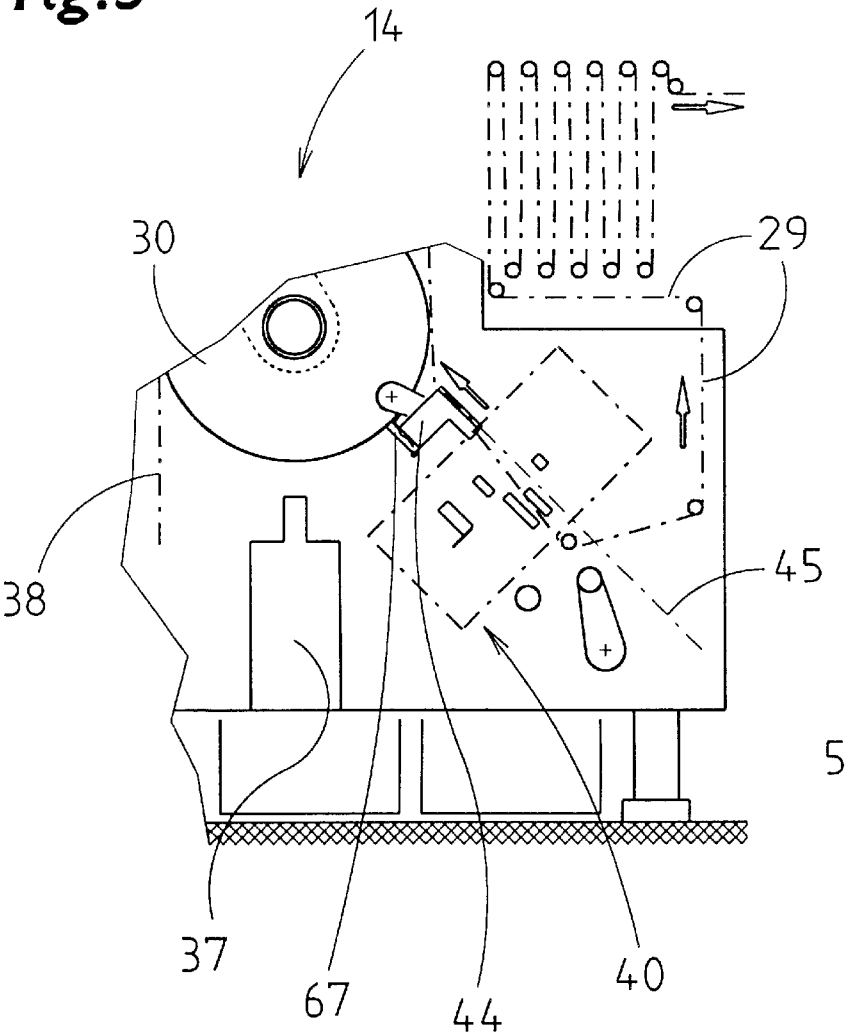

The construction and functioning of the connecting assembly 40 are illustrated schematically in FIGS. 3 to 14. For the purpose of gripping the initial part 35 of the new web 34, the web pickup 44 is advanced, along the movement plane 45, up to the new reel 30 until the retaining element—gripper 67—can grip the web leg 39, which is hanging down freely (FIG. 5). Thereafter, the web pickup 44 returns into the bottom, starting position, it being the case that the initial part 35 is drawn off from the new reel 30 and guided through the connecting assembly 40. The relative position of the initial part 35 in the region of the connecting assembly 40 is determined by a guide roller 47 which is arranged on a pivot arm 48.

Retaining elements for the run-off web 29, on the one hand, and the new web 34, on the other hand, are arranged in the region of the connecting assembly 40. These elements are clamping parts 49, 50 for the run-off web 29, on the one hand, and clamping parts 51, 52 for the new web 34, on the other hand, it being possible for said clamping parts to be moved with respect to one another. The run-off web 29 and new web 34 are guided such that they run through between the associated clamping parts 49, 50 and 51, 52, respectively. The clamping parts 49, 50, on the one hand, and 51, 52, on the other hand, are arranged in offset planes with respect to one another, in accordance with the movement planes of the run-off web 29 and new web 34.

Figure 7:
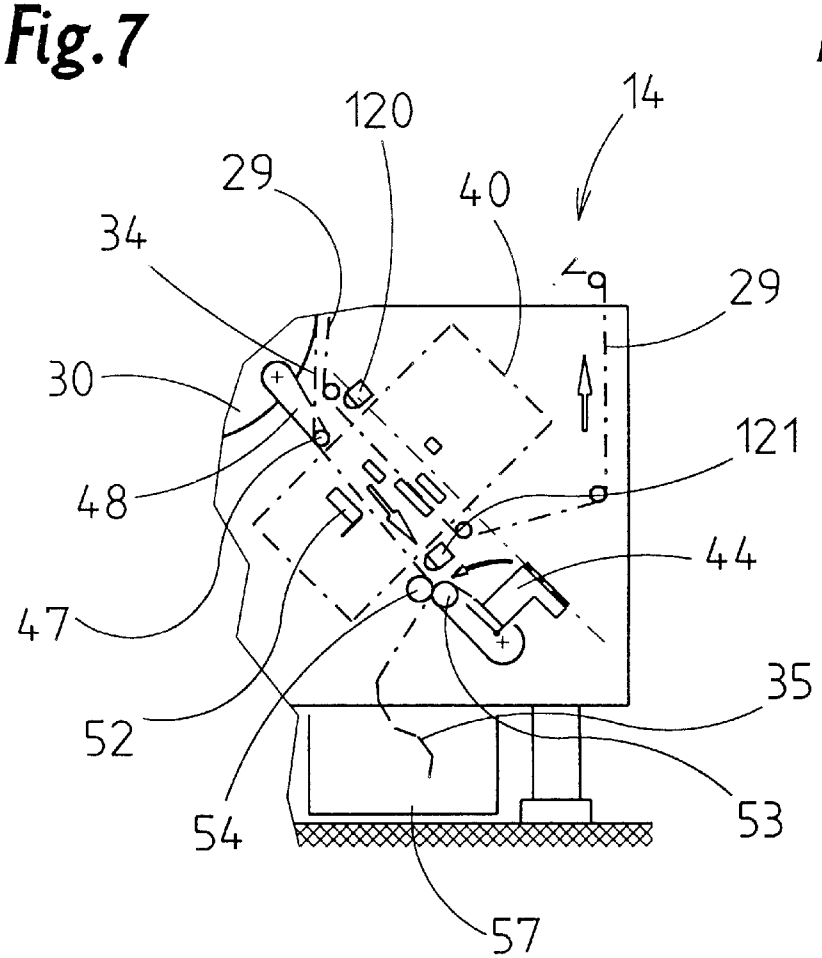

Before initiation of the operation for connecting the webs, the initial part 35, retained by the web pickup 44, is transferred to another retaining element, namely to a (stationary) conveying roller 53 with mating roller 54. The initial part 35, retained by the web pickup 44, runs between these rollers. The mating roller 54, on a lever 55, is pressed against the conveying roller 53, the initial part 35 being carried along in the process. The initial part 35 is then released by the web pickup 44 and fixed between the conveying roller 53 and mating roller 54 (FIG. 7). The conveying roller 53 and mating roller 54 draw off a relatively long region of the initial part 35 from the new reel 30, with the result that a free web part hangs down (FIGS. 7 and 8).

Figure 8:
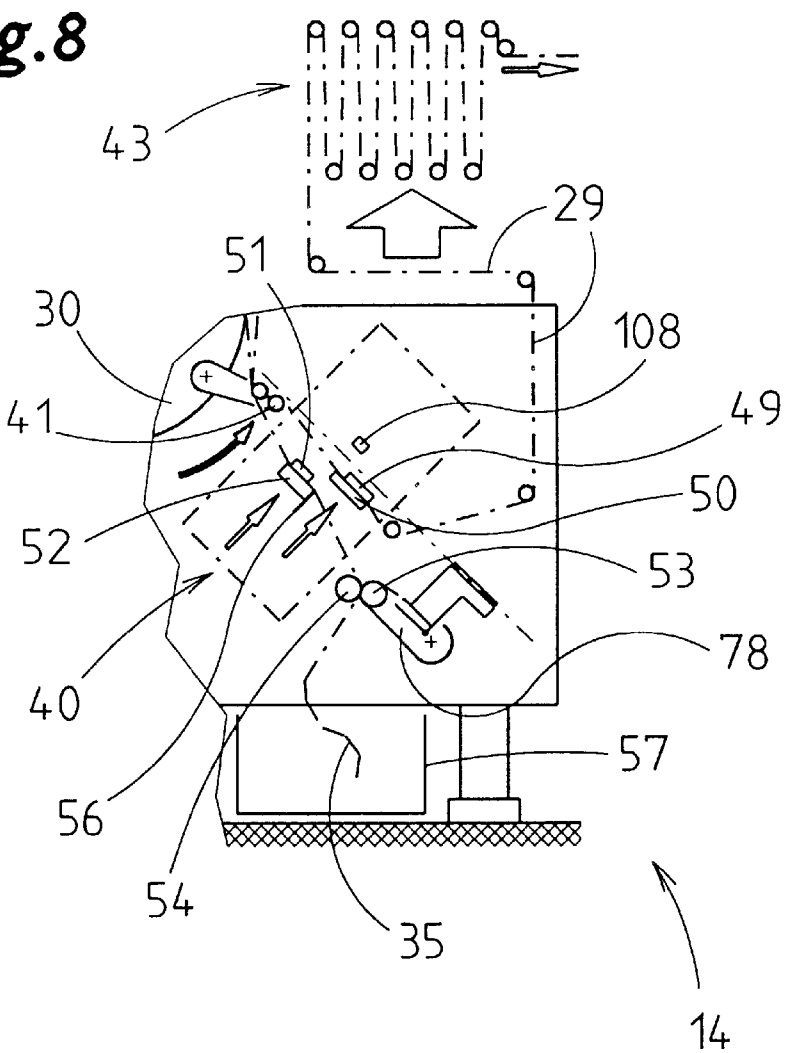

The clamping parts 49, 50 and 51, 52 are then moved towards one another, the run-off web 29, on the one hand, and the new web 34, on the other hand, being gripped and secured in the process (FIG. 8). During this phase, the conveying movement of the run-off web 29 is interrupted in the region of the connecting assembly 40.

When the new web 34 or the initial part 35 is gripped by the clamping parts 51, 52, or immediately after this, the initial part 35 is severed from the new web 34 by a severing cutter 56, which is assigned to the clamping parts 51, 52 and/or attached thereto. The freed initial part 35 is conveyed out of the connecting assembly 40, to be precise by the conveying roller 53 with a mating roller 54. The initial part 35 drops into a container 57 arranged beneath the connecting assembly 40.

Figure 9:
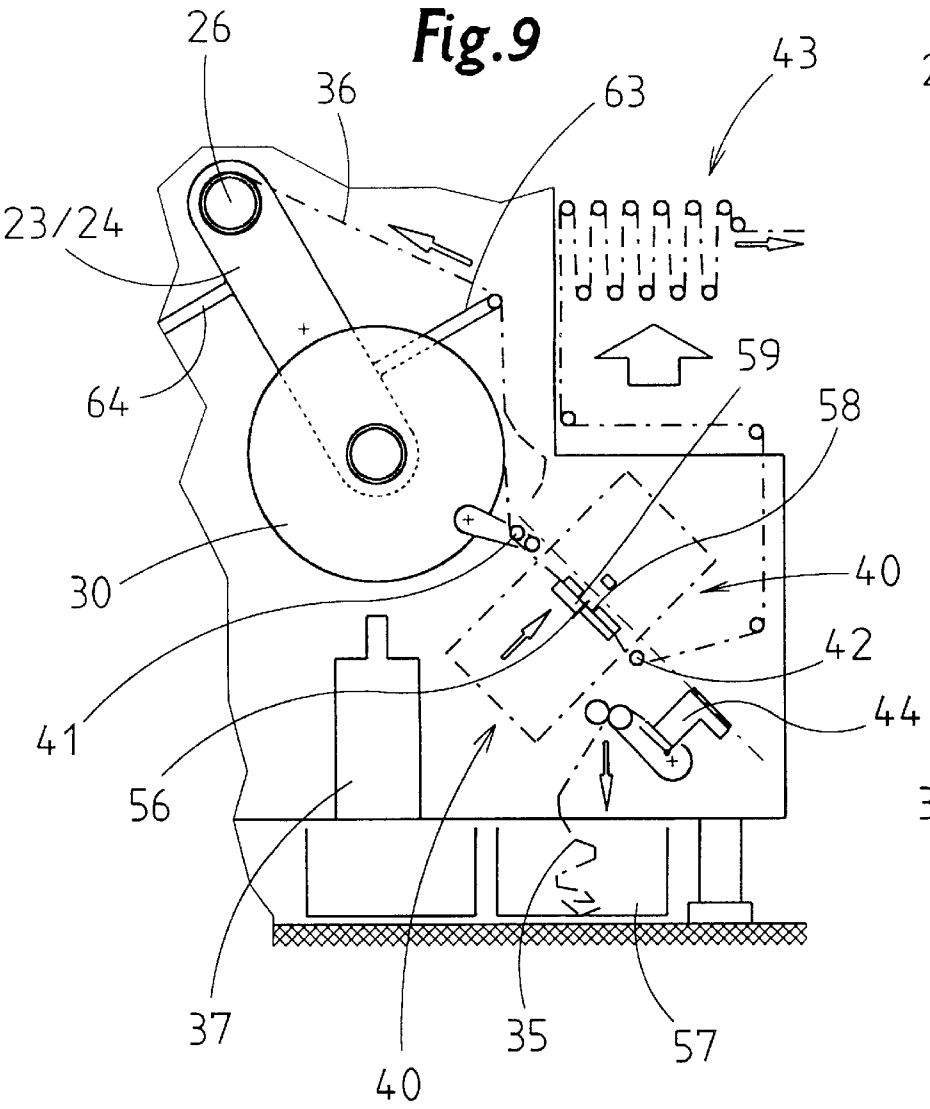

The run-off web 29 is likewise severed at the same time or at a discrete point in time, to be precise such that the run-off web 29, which is directed towards the packaging machine 12, is retained by the clamping parts 49, 50, but the severed end part 36 is free (FIG. 9). The run-off web 29 is severed by the (common) severing cutter 56, which is moved into the region of the run-off web 29 together with the clamping parts 51, 52 (FIGS. 8 and 9).

The clamping parts 49, 50; 51, 52 are arranged such that they are located one beside the other once the two webs have been severed, with the result that a run-off end 58 of the run-off web 29 and a new, initial portion 59 of the new web 34 are positioned directly adjacent to one another, if appropriate with an overlap or at a small distance apart, to be precise in a common plane.

In this position, it is possible for the run-off end 58 and new, initial portion 59 to be connected to one another, in the present case by an adhesive strip or by a tape 60. The latter is fed by a tape holder 61 and pressed onto the run-off end 58 and new, initial portion 59 on the free side, namely between adjacent clamping parts 49 and 51. The connection between the webs, namely run-off web 29 and new web 34, is thus produced (FIG. 10).

Figure 12:
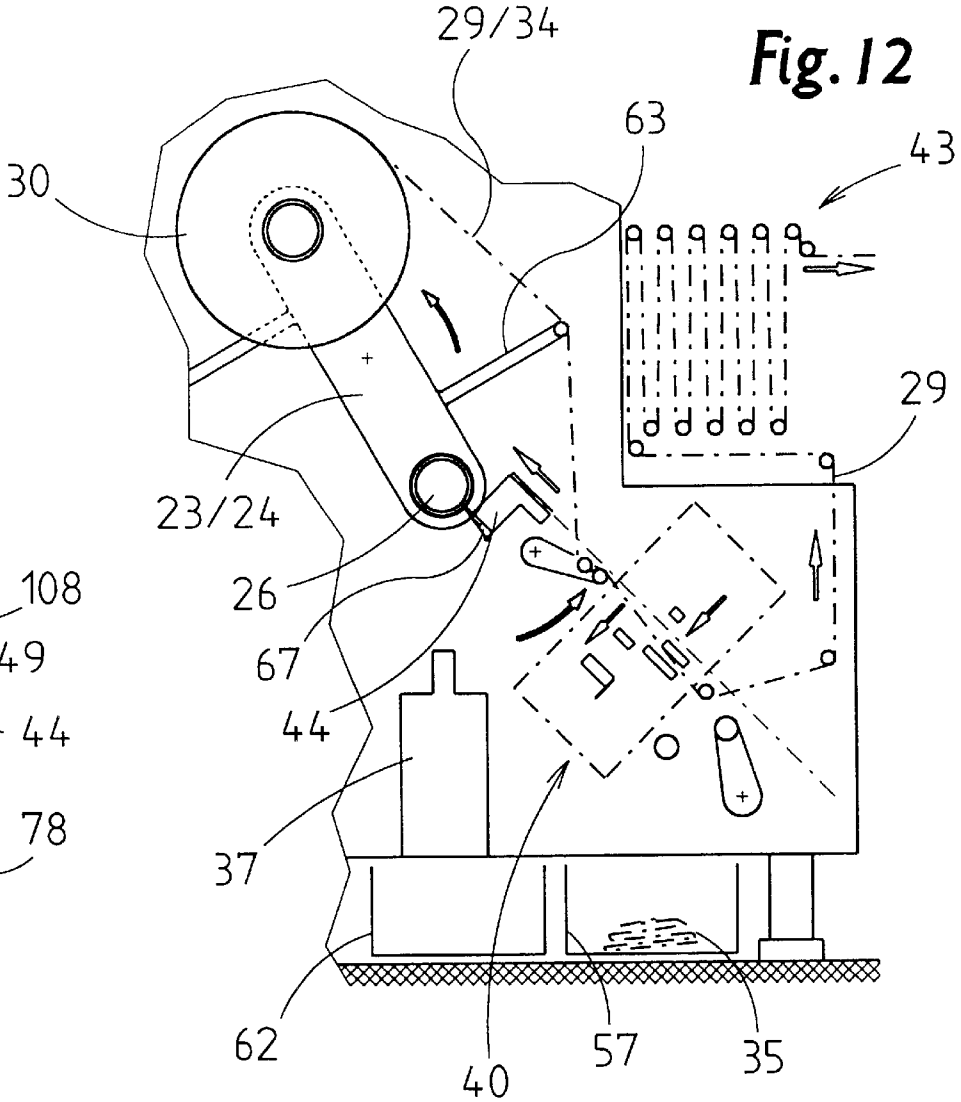
Figure 11:
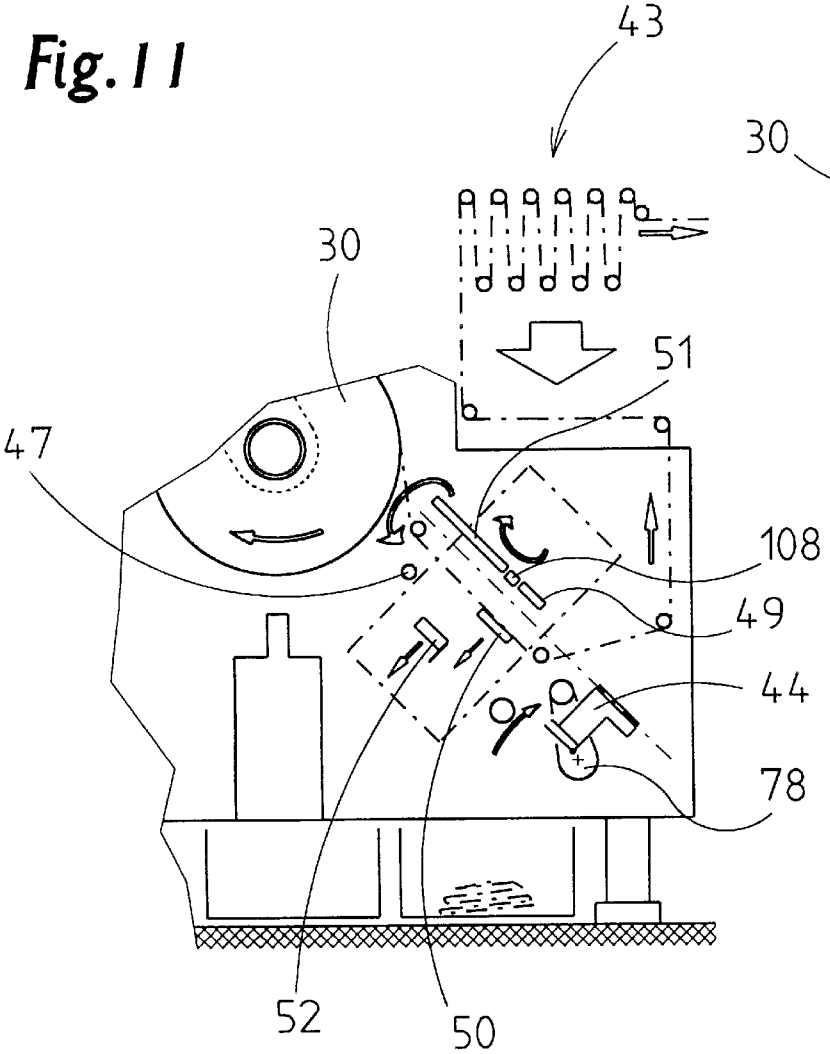

The resulting new run-off web 29 is released by virtue of the clamping parts 49–52 being moved apart from one another (FIG. 11). Transportation of the run-off web 29 is resumed again. Meanwhile, the web store 43 has been reduced and can now be built up again by a correspondingly increased conveying capacity (FIG. 12). The clamping parts 49–52 return into the starting position according to FIG. 3 during this time.

Figure 13:
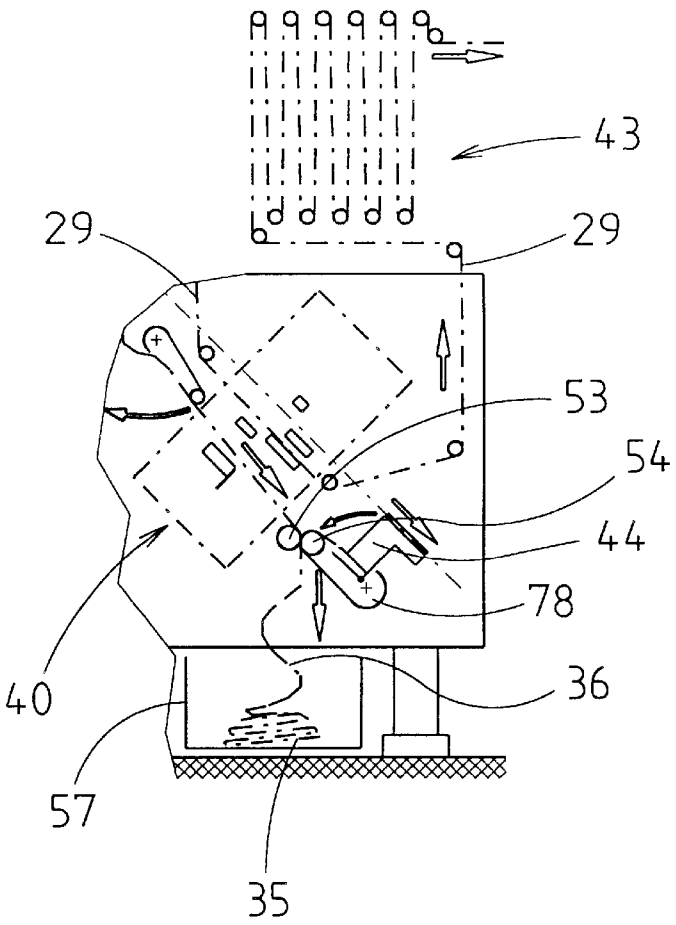

Further pivoting of the reel arm 23, 24 in the anticlockwise direction moves the (new) run-off reel 28 into a top position, remote from the connecting assembly 40 (FIG. 12). The former run-off reel 28 with the remnants of the run-off web 29, namely the end part 36 and the reel core 11, is moved into the bottom position, when the reel arm 23, 24 is positioned obliquely. In this position, the (former) operating stub 26 is located in the operating region of a disposal element, namely the web pickup 44. By corresponding movement along the movement plane 45, said web pickup is advanced up to the remains of the run-off reel 28. The end part 36 provided there is gripped and drawn off from the reel core 11 by virtue of the web pickup 44 returning into the starting position (FIG. 13). The end part 36 is transferred, in the manner which has likewise already been described, to the drawing-off element, namely to the conveying roller 53 and mating roller 54. These transport the end part 36 into the container 57, in which the initial part 35 is already located.

Figure 10:
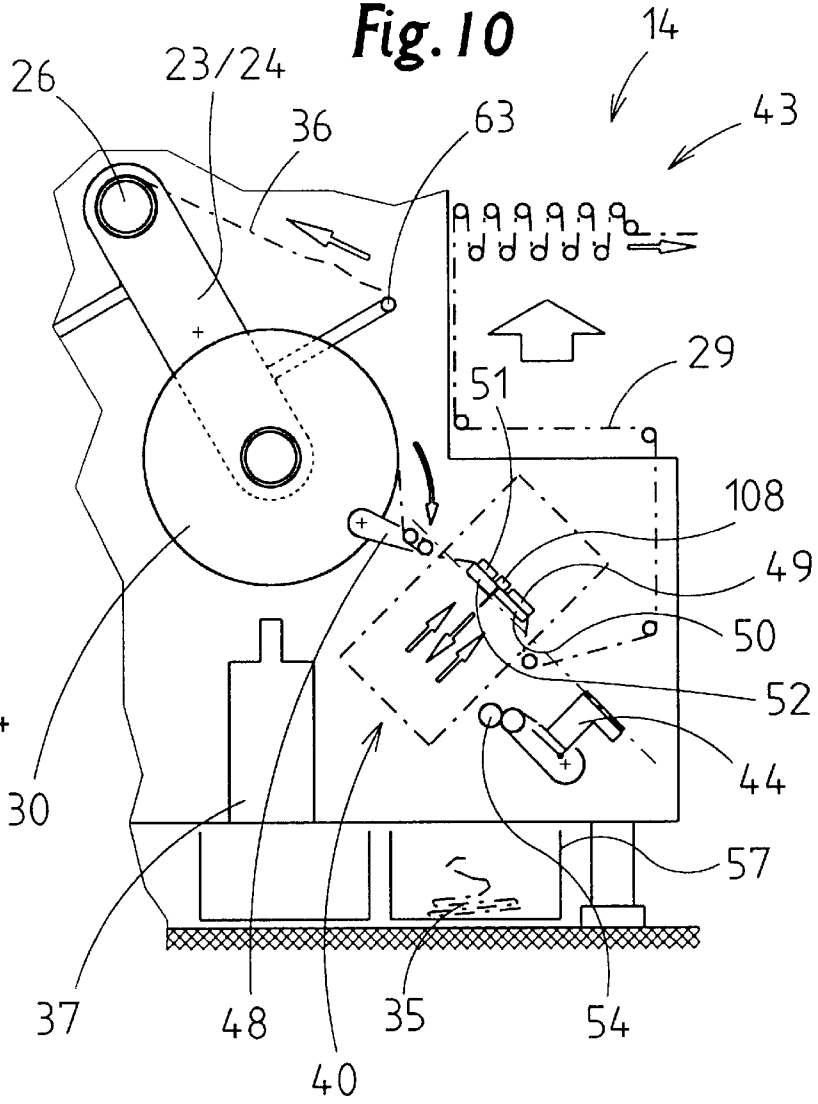

In order that the end part 36 of the (former) run-off web 29 does not disrupt subsequent operations once severing has taken place, it is provided that the end part 36 is wound up on to the operating stub 26 by virtue of the latter being driven in the opposite direction (FIGS. 9 and 10).

Figure 14:
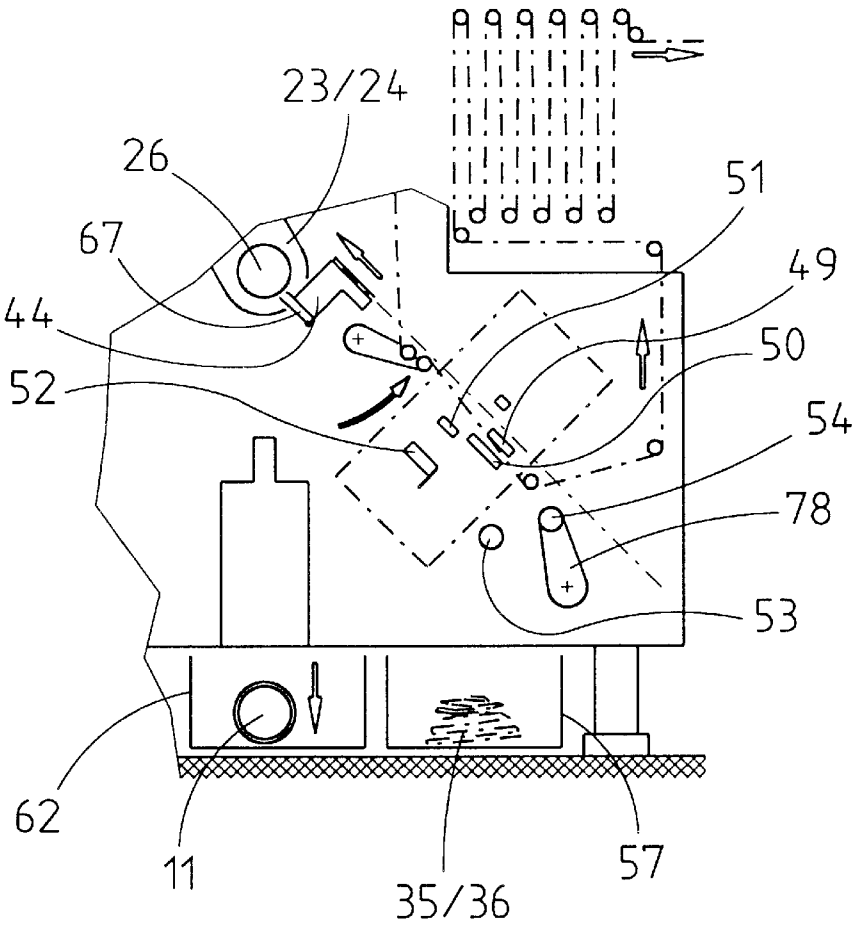

Once the end part 36 has been removed, a drawing-off element for the (empty) reel core 11 takes effect. This operating step is also carried out here by the web pickup 44. According to FIG. 14, the web pickup is, once again, moved up to the former operating stub 26. The retaining element grips the reel core 11 and moves it in an axial direction from the operating stub 26. The free reel core 11 passes, by virtue of its own weight, into a separate collecting container 62 (FIG. 14).

By virtue of the reel arm 23, 24 being pivoted in the opposite direction—clockwise direction—the run-off reel 28 returns into the actual operating position according to FIG. 2. The free supply stub 27 is kept on standby in the region of the reel magazine 16, 17 for the purpose of receiving a new reel (new reel 30).

For correct guidance of the material web during the pivot movements and in the different positions of the reel arm 23, 24, a guide element for the material web is arranged on the reel arm 23, 24, to be precise a supporting bracket 63, 64 assigned to each reel and/or each stub on the reel arm 23, 24. The two supporting brackets 63, 64 are arranged on opposite sides of the reel arm 23, 24 and cause the respective material web to be guided at a distance from the respectively other stub.

An important element with great versatility is the web pickup 44. This is illustrated in detail in FIGS. 15 to 18. The web pickup 44 is connected to a stationary linear unit 65 in a displaceable manner. Said linear unit extends in the movement plane 45, that is to say it is correspondingly obliquely directed. The web pickup 44 is positioned beneath the linear unit 65 and is connected to the stationary linear unit 65 in a displaceable manner via a connecting element, namely a carriage 66.

Figure 16:
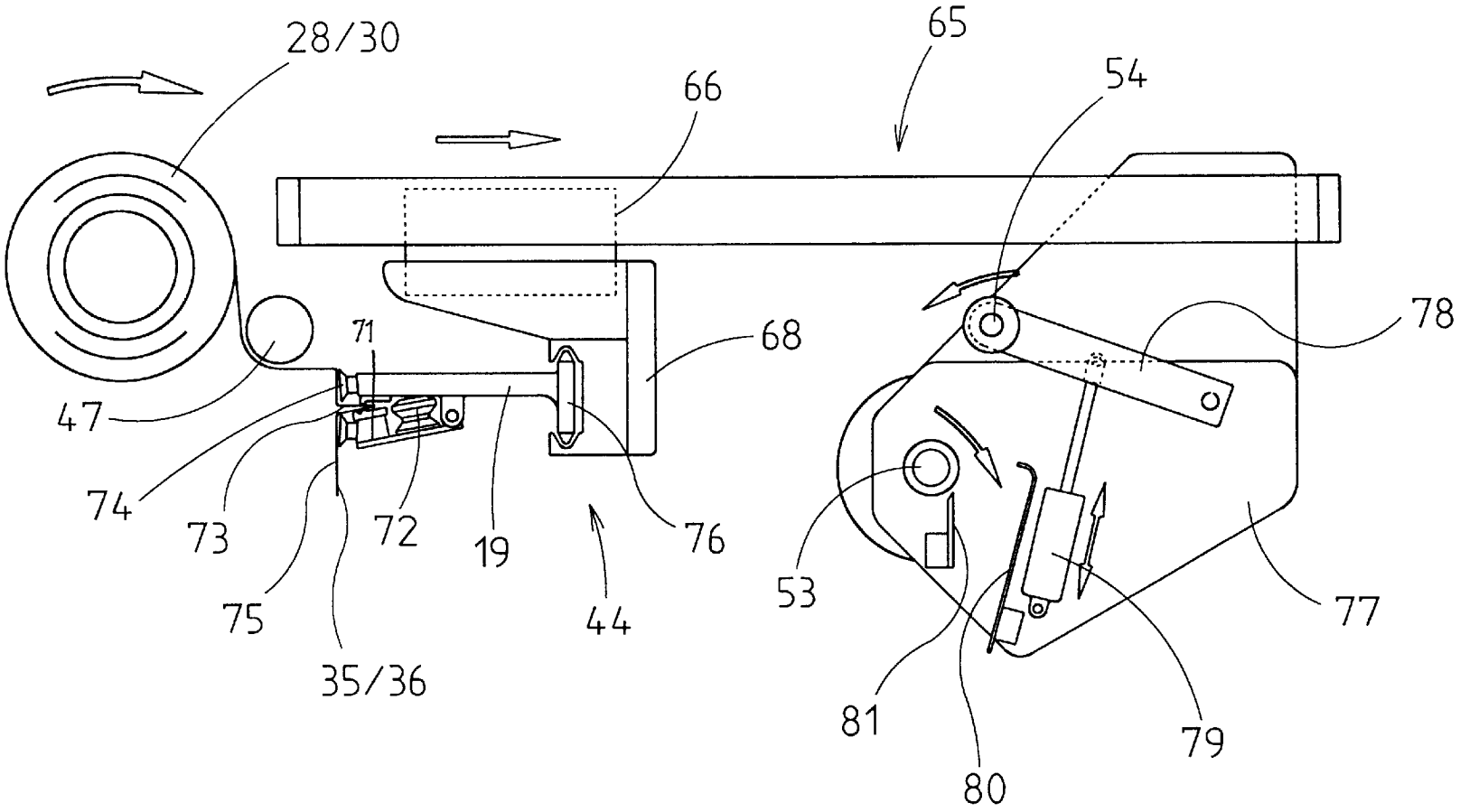

An element which is intended for gripping and retaining the material web, namely the initial part 35 or the end part 36, comprises a gripper 67. The latter is attached to a mount 68 connected to the carriage 66. In the present case, the gripper 67 comprises clamping elements for the purpose of gripping the material web, namely two clamping jaws 69, 70 which can be moved relative to one another. In the case of the exemplary embodiment shown, the clamping jaw 69 is arranged in a fixed manner, to be precise on a carrying arm 19. The other clamping jaw 70 is attached to a movable carrier, namely to a pivot arm 71. By virtue of the pivot arm 71 being actuated, namely moved upwards, the (bottom) clamping jaw 70 is moved against the fixed clamping jaw 69, to be precise by an actuating cylinder 72. In this case, a previously formed fold or loop 73 of the material web is clamped in between the clamping jaws 69, 70 and gripped in this way (FIG. 16). Thereafter, the gripper 67 can be moved along the linear unit 65, out of the position in which it is directed towards the respective reel or the respective stub (FIG. 16), into the starting position (FIG. 17), the material web (initial part 35, end part 36) being carried along in the process.

Figure 15:
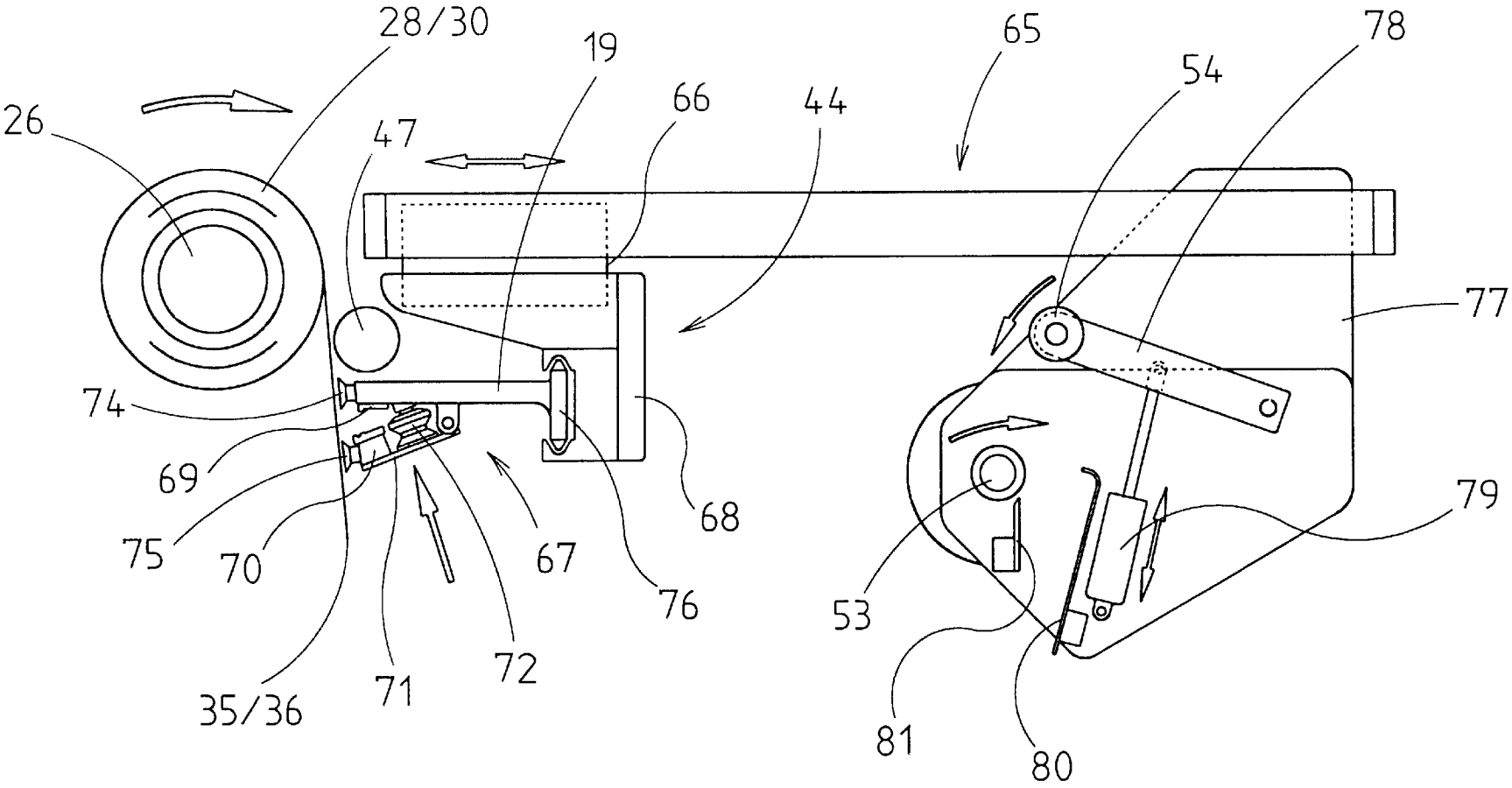
FIGS. 15 to 17 show, on an enlarged scale, side views of a web-retaining means for the purpose of drawing off a material web, in various operating phases.

For the purpose of gripping the material web, the gripper 67 is provided with elements for forming the loop 73 and for introducing the same into the position between the clamping jaws 69, 70. These elements are two (or more) spaced-apart suckers 74, 75. These grip the material web in a position in which they are spaced apart from one another by a (relatively large) distance (FIG. 15). Thereafter, the two suckers 74, 75 are moved towards one another, in the present case by the upward movement of the bottom sucker 75, which is attached to the pivot arm 71. This relative movement produces the loop 73 between the two suckers 74, 75. This forms a lateral deflection of the material web, the loop 73 automatically being moved between the two clamping jaws 69, 70 and gripped by the same (FIG. 16). The stationary, top sucker 74 is attached to the end of the carrying arm 19, in extension of the same.

The gripper 67 is attached to the mount 68 in a transversely movable manner, to be precise by way of a connecting-link guide 76. This transverse movement is necessary when the gripper 67—by corresponding use of the suckers 74, 75—draws off the empty reel core 11 from the respective operating stub 26 by virtue of axial movement. In this case, at least one of the suckers 74, 75 grips the reel core 11. The carrying arm 19 is connected to the connecting-link guide 76.

Figure 17:
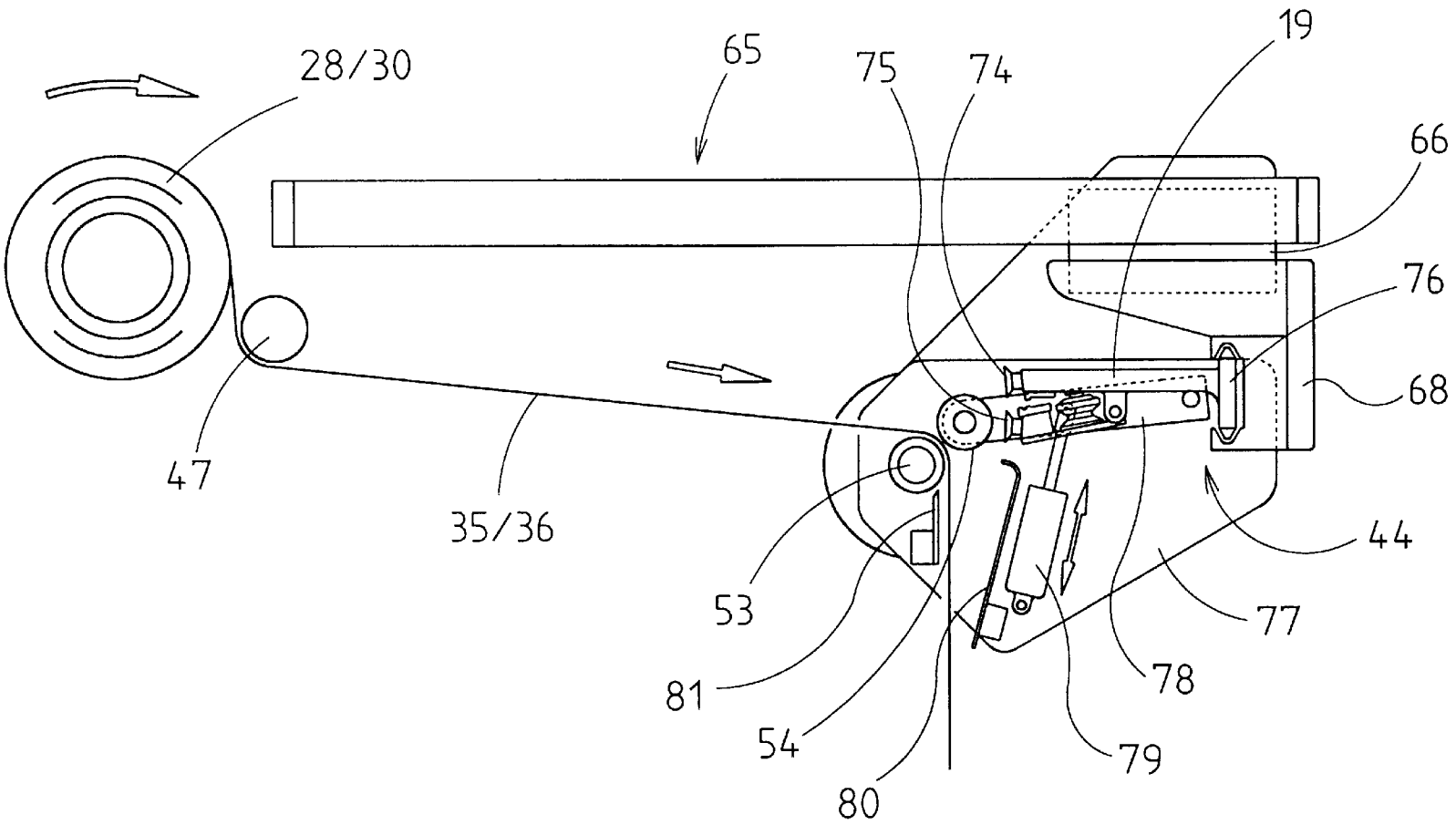
Figure 18:
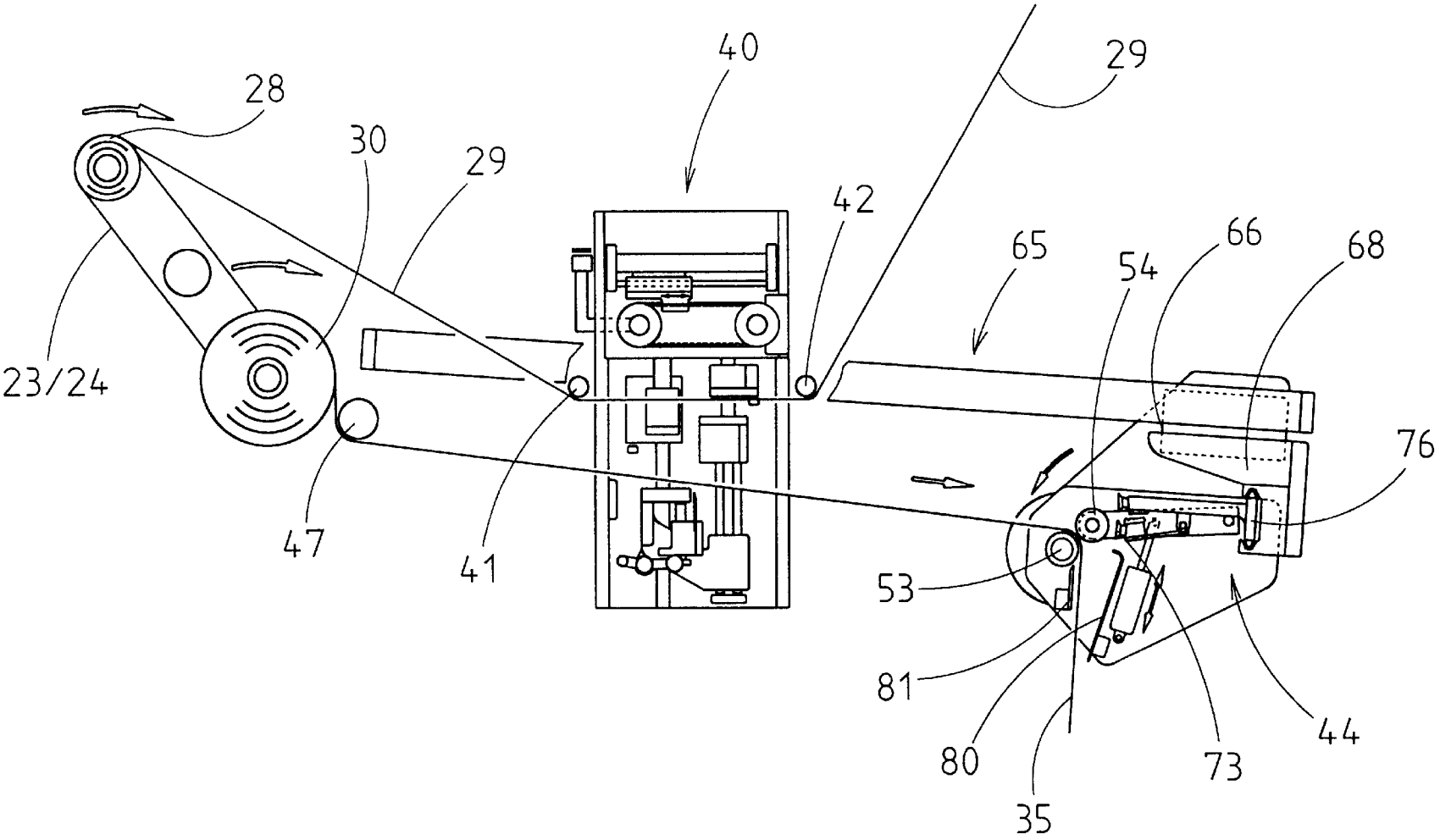
FIG. 18 shows an illustration of the web-retaining means corresponding to FIGS. 15 to 17 in conjunction with a connecting assembly for material webs.
Figure 19:
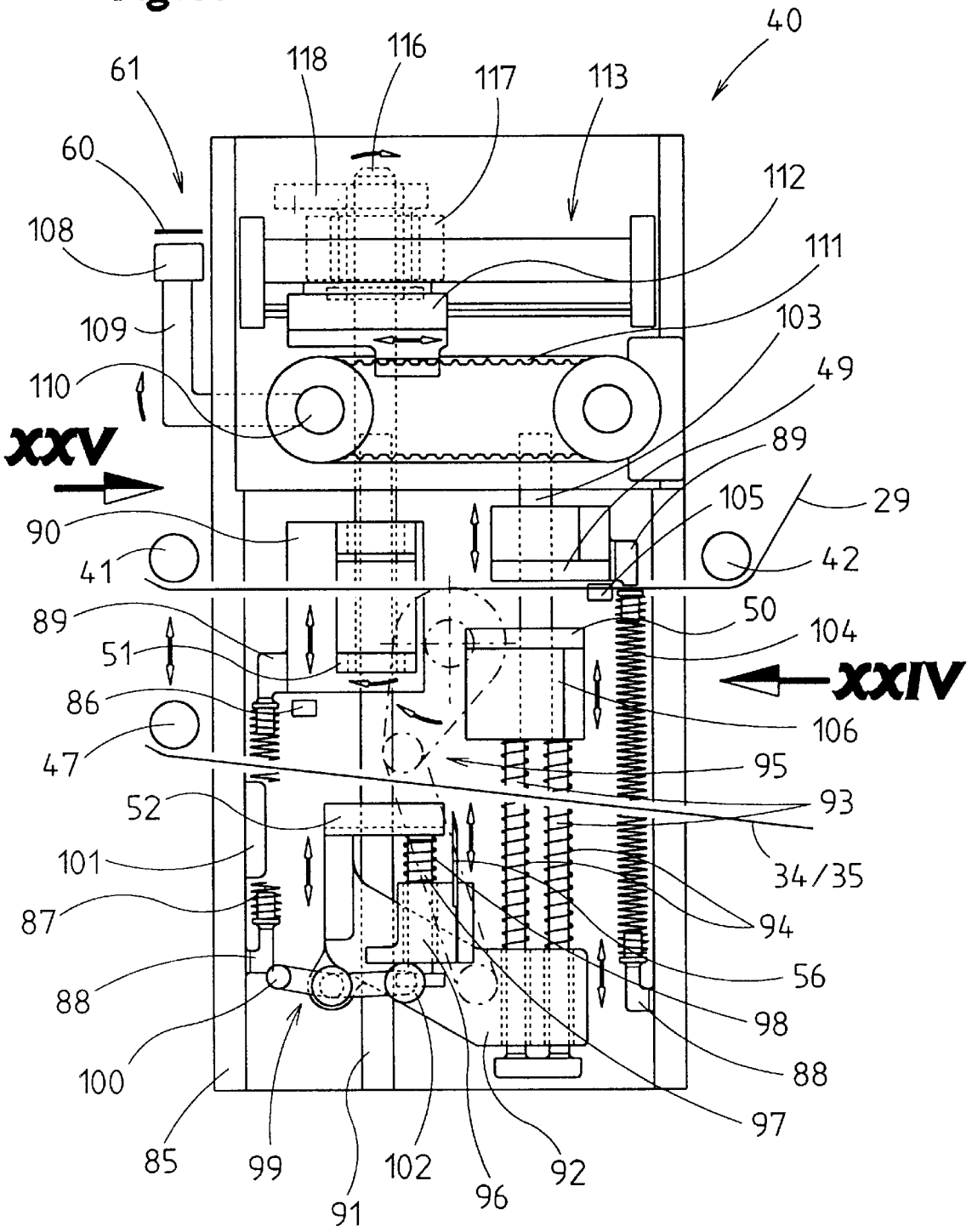
FIGS. 19 to 23 show side views of the connecting assembly for the material webs in various operating phases.

During the movement of the web pickup 44 out of the receiving position, according to FIG. 15, into the other end position, according to FIG. 17, the respective web is moved through, in the described manner, between the spaced-apart rollers, namely conveying roller 53 and mating roller 54 (FIG. 6). The (bottom) conveying roller 53 is mounted on a carrying wall 77 in a stationary manner. The movable, mating roller 54 is attached to an actuating lever 78. The latter can be pivoted by a cylinder 79, with the result that, in a bottom position, the mating roller 54 butts against the conveying roller 53 and presses the material web against the same (FIG. 17). The material web is deflected downwards around the conveying roller 53. The correct guidance of the material web is ensured by a directing element, namely by a directing plate 80, which is attached to the carrying wall 77 in an oblique position, between the conveying roller 53 and cylinder 79.

Moreover, the conveying roller 53 is assigned, on the opposite side of the material web, a guide plate 81. This is positioned directly adjacent to the circumference of the conveying roller 53 and prevents the material web which is guided around the conveying roller 53 from being wound up on to the same.

Special features of the configuration and functioning of the connecting assembly 40 are shown in detail in FIGS. 19 to 25.

The connecting assembly 40, which is designed as a self-contained unit, has an overall approximately cuboidal configuration. Various elements are mounted directly or indirectly on an upright carrying framework 82, which comprises upright carrying walls 83, 84 and transverse walls 85 arranged in a box-like manner.

The clamping parts 49–52 are important elements for connecting assembly 40. The clamping parts 51, 52, which are assigned to the new web 34 or the initial part 35 thereof, can be moved up and down independently of one another. At the beginning of the connecting operation, the (top) clamping part 51 is located in the bottom end position, in abutment against a fixed stop 86. The clamping part 51 is retained in this bottom position by elastic force, in the present case by a tension spring 81, which is connected to a bottom attachment 88 on the transverse wall 85 and to a top attachment 89 with a carriage 90. The latter, in turn, has the top clamping part 51 attached to it. The carriage can be displaced in the vertical direction on an upright, fixed guide 91.

The bottom clamping part 52 is connected to a carriage 92, which is offset laterally with respect to the clamping part 52 and can be displaced on upright guide rods 93. The carriage 92, and thus the clamping part 52, can be displaced upwards counter to downwardly directed, elastic pressure. For this purpose, compression springs 94 are arranged on the guide rods 93.

Figure 21:
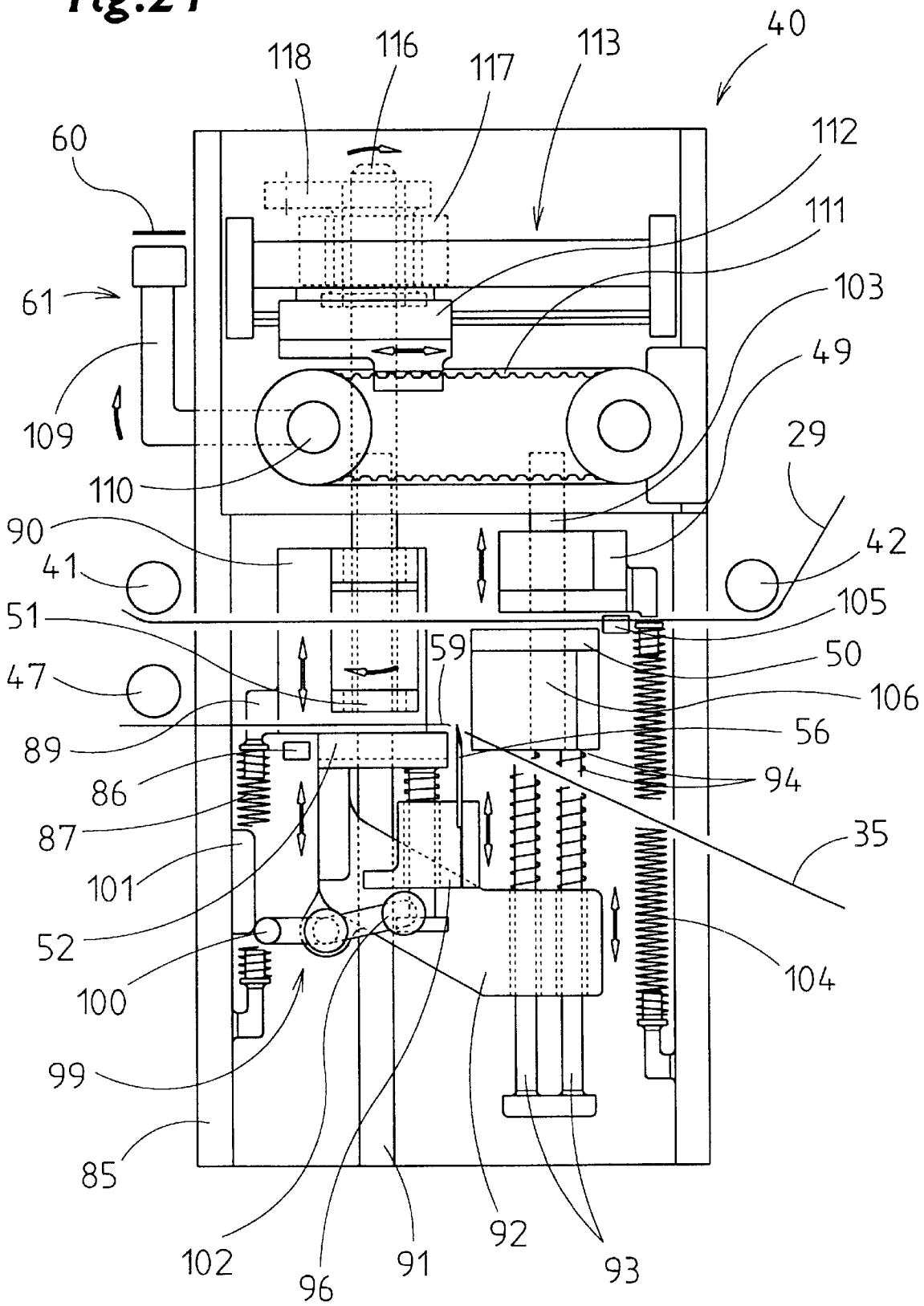

The carriage 92 can be moved up and down by a crank mechanism 95. The latter moves the carriage 92 with the clamping part 52 upwards, the new web 34 or the initial part 35 being clamped in a raised position by abutment against the clamping part 51 (FIG. 21).

Thereafter, the severing cutter 56 is actuated. This is arranged on the unit comprising the clamping part 52 and carriage 92 such that it can be moved relative thereto. For this purpose, a carrying body 96 for the upwardly directed severing cutter 56 can be moved upwards counter to the pressure of a spring 98 on upright slide rods 97 when a severing cut is to be carried out. In this case, the severing cutter 56 is moved directly alongside the clamping part 52, on the side is which is directed away from the new reel 30.

For the purpose of actuating the severing cutter 56 by virtue of displacement of the carrying body 96, use is made of a pressure-exerting lever 99, which is attached pivotably to the unit comprising the pressure-exerting part 52 and carriage 92. One end 100 of the two-armed pressure-exerting lever 99 runs against a fixed protrusion 101 and, as upward movement continues, is pivoted in the anticlockwise direction such that a pressure-exerting roller 102, which is arranged opposite the end 100, moves the carrying body 96 with the severing cutter 56 upwards, the severing cut being carried out in the process (FIG. 21).

The clamping parts 49, 50 for the run-off web 29 are positioned at a higher level in the connecting assembly 40 than the clamping parts 51, 52. The top clamping part 49 can be moved up and down on an upright guide 103. The clamping part 49 is moved into a bottom end position by a lateral tension spring 104 and is retained in this position by abutment against a fixed stop 105.

The associated bottom clamping part 50 can be moved up and down, likewise on a guide 103, by way of a guide body 106. The guide body 106 is connected to the top ends of the guide rods 93. During upward movement of the carriage 92, the guide body 106, and thus the bottom clamping part 50, is raised, via the compression springs 94, out of a position according to FIG. 19 into the clamping position according to FIG. 20. The necessary clamping pressure is produced by the increase of the compressive force from the compression springs 94 when the carriage 92 is moved further upwards, to be precise first of all into the position according to FIG. 21 and then into the position according to FIG. 22. During this movement phase, the severing cut is also carried out in the region of the runoff web 29, the severing cutter 56 remaining in the upwardly extended cutting position by virtue of the configuration of the protrusion 101 (FIG. 22).

Following the severing cut in the region of the run-off web 29 (FIG. 22), the pairs of clamping parts 49, 50, on the one hand, and 51, 52, on the other hand, are located on the same level. The end 100 of the pressure-exerting lever 99 has left the protrusion 101 (FIG. 23). The severing cutter 56 has been moved out of the cutting position. It is then possible, on the opposite, top side, for the adhesive strip or the tape 60 to be pressed from above, by way of the tape holder 61, onto the mutually facing web ends, namely on to the run-off end 58 and the new, initial portion 59.

Figure 22:
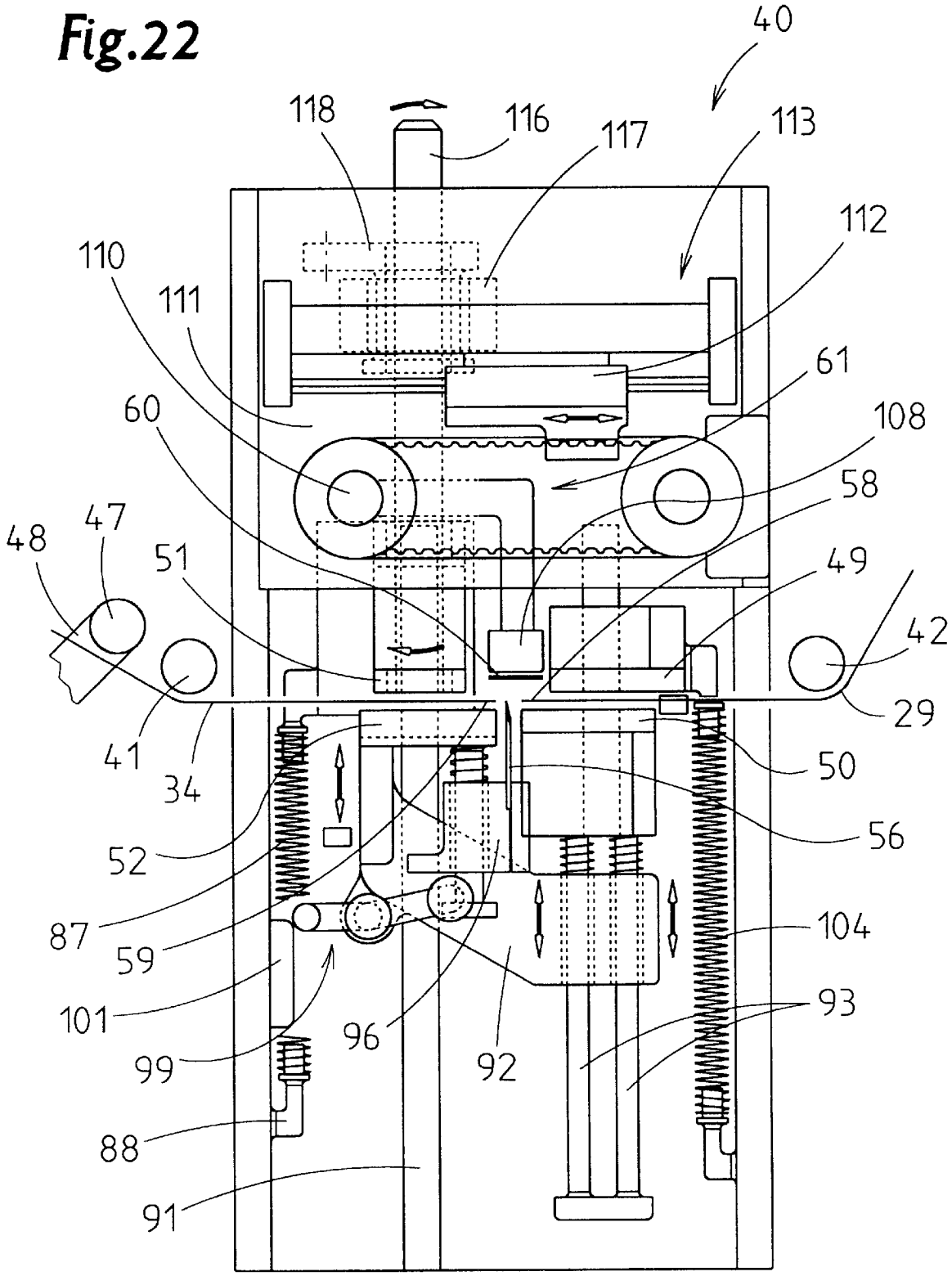
Figure 23:
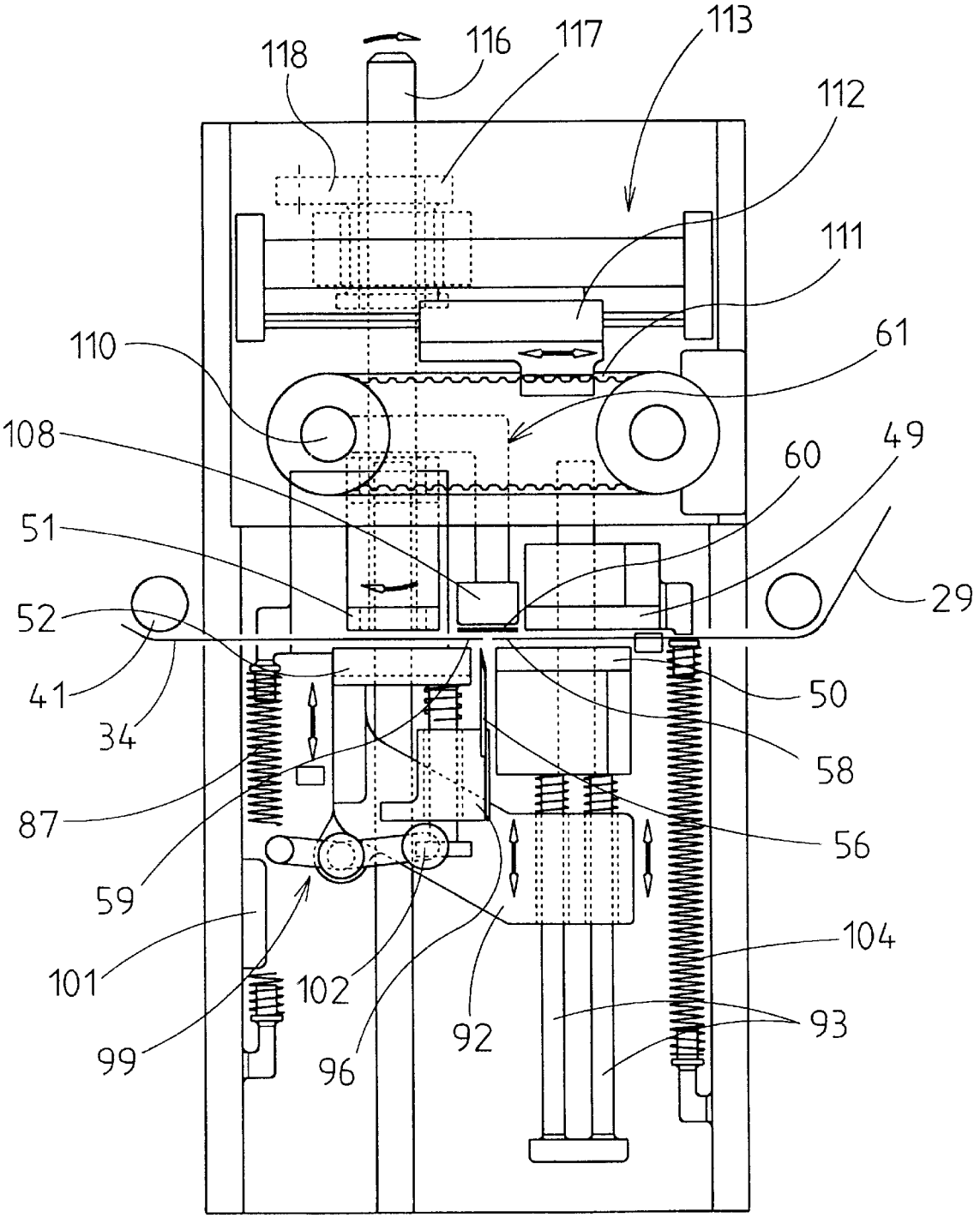
Figure 24:
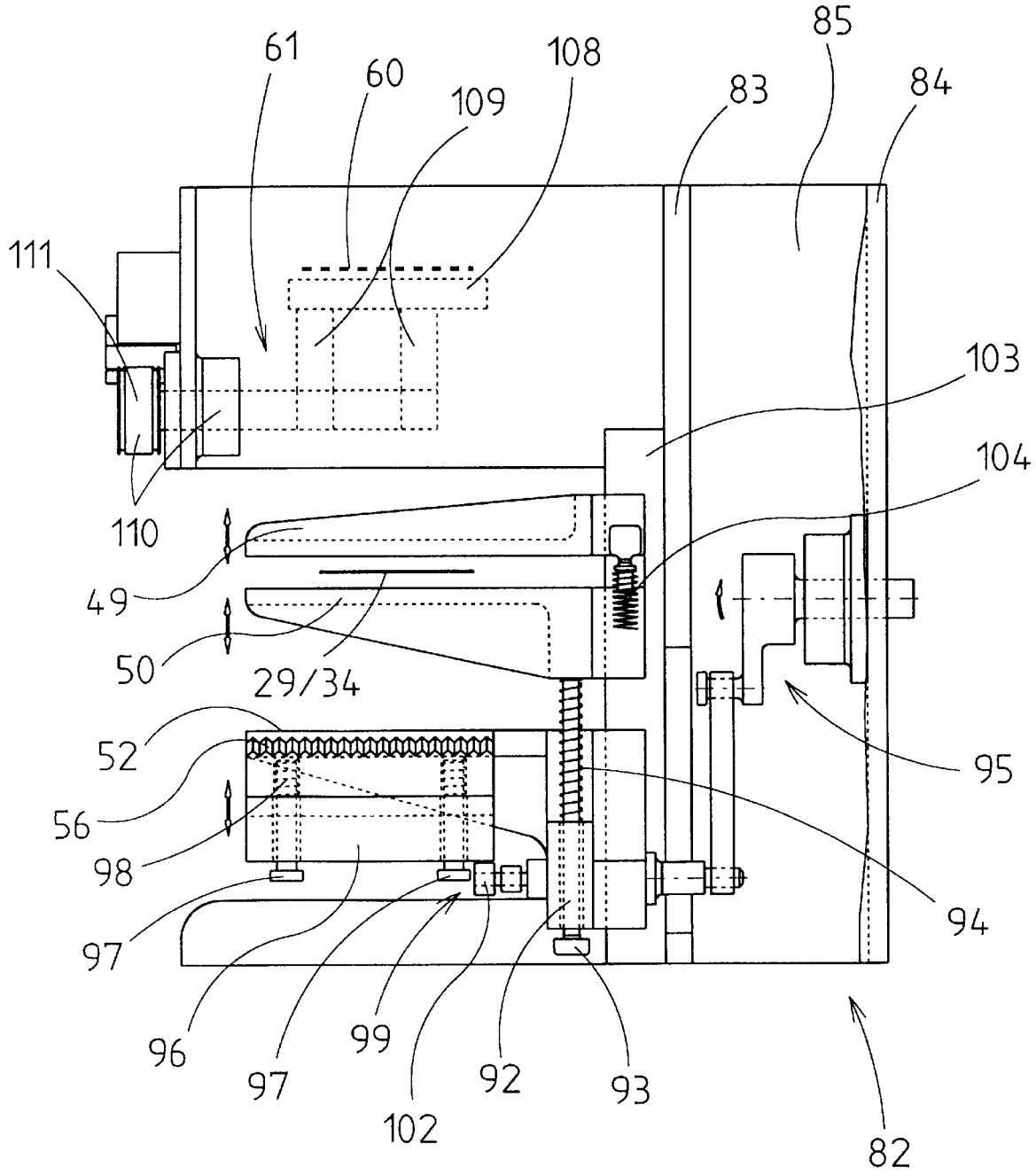
FIG. 24 shows a region of the connecting assembly in a view in accordance with arrow XXIV in FIG. 19.

The web parts which have been released in each case following the severing cuts, namely the initial part 35, on the one hand, and the end part 36, on the other hand, are released in the described manner in the positions according to FIGS. 21 and 22, respectively.

The tape holder 61 is designed in a particular way. This holder is a pivotable tape lever 107, at the end of which there is arranged a retaining head 108 with suction bores (not shown) for the purpose of retaining the tape 60 by means of suction air. In the starting position (FIG. 20), the angled tape lever 107 is directed upwards by way of an end leg 109. It is thus possible for the tape 60 to be positioned on the top side of the retaining head 108. The tape lever is pivoted through 180°, with the result that the end leg 109, with the retaining head 108, is directed downwards, an adhesive being located on the free, downwardly directed side of the tape 60. The retaining head 108, with the tape 60, is pressed on to the mutually facing ends of the material web, namely on to the run-off end 58, on the one hand, and the new, initial portion 59, on the other hand, with the result that these can be connected to one another. The suction air for retaining the tape is switched off here.

In specific terms, the procedure for attaching the tape 60 to the run-off web 29 and new web 34 is such that the retaining head 108, with the tape 60, is positioned at a small distance above the material webs. By virtue of a small displacement, the clamping parts 49, 50; 51, 52, which are located in the clamping position, are raised together, as a result of which the ends of the material webs are pressed on to the retaining head 108 or on to the tape 60. The crank mechanism 95 is designed such that this displacement is carried out in the end phase of a full revolution (FIG. 10).

The tape lever 107 is connected to a rotary bearing 110 in a pivotable manner. In the present case, the tape lever 107 is rotated via an endless driven member, namely via a toothed belt 111, which can be driven back and forth and, in the process, carries out the aforementioned rotary movement in the region of the rotary bearing 110. Part of the rotary bearing 110 is, at the same time, a deflection wheel for the toothed belt 111.

In order to carry out the movement back and forth, the toothed belt 111 is moved directly, to be precise by way of a coupling part 112 which is connected to it and to a linear drive mechanism 113. The coupling part 112 is moved back and forth by the linear drive mechanism, as a result of which the tape lever 107 is pivoted correspondingly.

Figure 20:
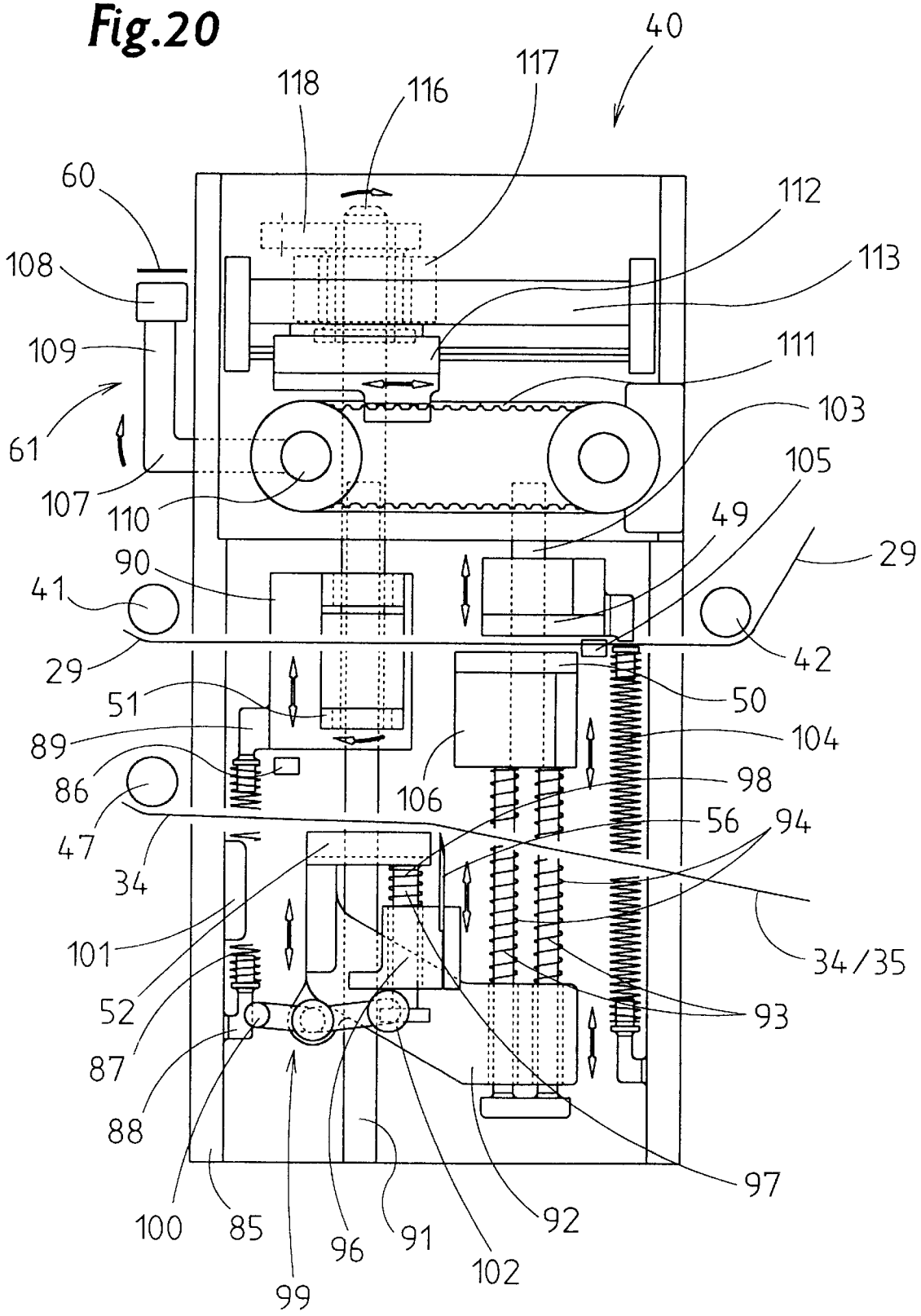

A further special feature resides in the movement of the clamping parts 49–52, to be precise of the top clamping part 51 in particular. Once the run-off web 29 has been connected to the new web 34, said clamping part has to be moved back out of a position above the (new) run-off web 29 (FIG. 23) into a position beneath the same (FIG. 20).

Figure 25:
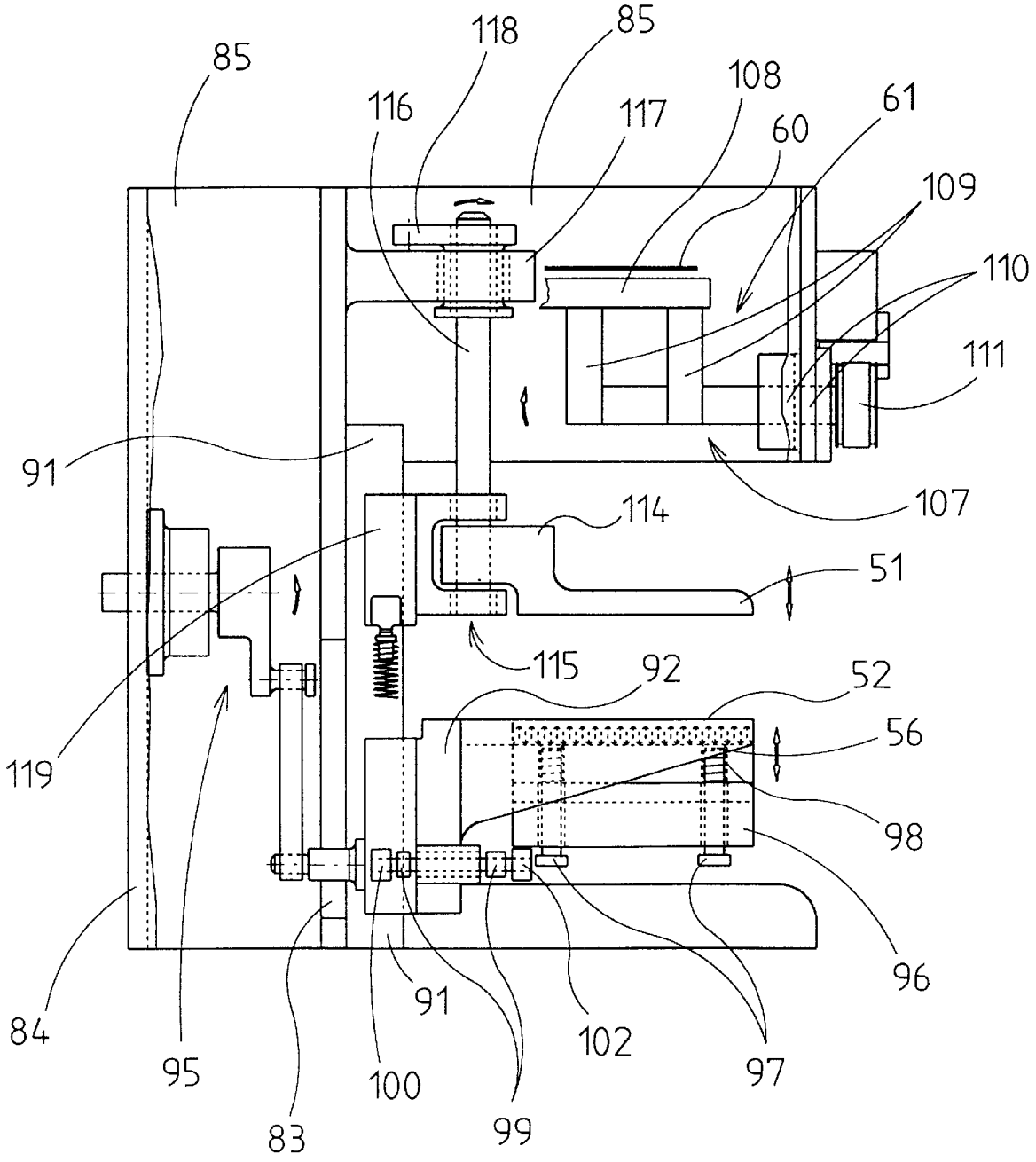
FIG. 25 shows a view of the connecting assembly in accordance with arrow XXV in FIG. 19.

For this purpose, the top clamping part 51 is designed as a projecting single-armed lever (FIG. 25). A bent end region 114 is connected fixedly to an upright rotary shaft 116 in the region of a fork-shaped rotary bearing 115. The rotation of the rotary shaft 116 moves the active, projecting part of the clamping part 51 out of the movement region of the run-off web 29 and into a position alongside said run-off web 29. The clamping part 51 can then be moved downwards, alongside the run-off web 29, into the position according to FIG. 19 and FIG. 20. FIG. 25 shows the position of the clamping part 51 beneath the run-off web 29.

A top end of the rotary shaft 116 is guided in a fixed retaining bearing 117. An actuating lever 118 which acts on the rotary shaft 116 in this region is connected to a suitable actuating element, e.g. a cylinder. By virtue of the actuating lever 118 being pivoted, the rotary shaft 116 is rotated in one direction or the other, with corresponding movement of the clamping part 51. The rotary shaft 116 is guided with sliding action in the retaining bearing 117, that is to say it can be moved up and down with the clamping part 51. FIGS. 22 and 23 show the top end position of the rotary shaft 116. The rotary bearing 115 can be moved up and down, by way of a slide body 119, on the common upright guide 91.

In the case of material webs with printing or other predetermined markings, in particular in the case of paper webs 32 with the conventional printing for a (cigarette) pack, the connection of the run-off web 29 and new web 34 takes place in a blank-related manner, that is to say in accordance with the printing provided for each blank. For this purpose, the procedure is such that the run-off web 29 and the new web 34 are stopped in a precise position in accordance with the printing. The clamping parts 49, 50, on the one hand, and 51, 52, on the other hand, are thus activated on account of a web-dependent control means, in order to stop the run-off web 29 and the new web 34 in appropriate positions relative to one another. For this purpose, the run-off web 29 and the new web 34 are monitored with reference to printing marks (not shown). Such printing marks are provided in a known manner on the material webs at intervals in accordance with the dimensions of printing or of a blank. A printing-mark reader 120 for the run-off web 29 and a printing-mark reader 121 for the new web 34 detect the printing marks and control the associated clamping parts 49, 50 and 51, 52, respectively. In the present case, the printing-mark readers 120, 121 are arranged outside the connecting assembly 40, to be precise the printing-mark reader 120 for the run-off web 29 is arranged on the inlet side of the connecting assembly 40 and the printing-mark reader 121 is arranged on the outlet side.

What is claimed is:

1. A process for connecting material webs made of packaging material or the like, namely a new, initial portion (59) of a new web (34) to a run-off end (58) of a run-off web (29), by adhesive bonding or by a tape (60), wherein the run-off web (29) and the new web (34) are gripped by clamping means and severed, and the resulting run-off end (58) is connected to the new, initial portion (59), said process comprising the steps of:

individually gripping in clamping means the run-off web (29), on the one hand, and the new web (34) on the other hand, and severing an initial part (35) and an end part (36) from the new web (34) and the run-off web (29), respectively; and positioning the resulting web ends, namely the run-off end (58) and the new, initial portion (59), adjacent to one another in a common plane for the purpose of connecting the web ends or attaching the tape (60).

2. The process according to claim 1, further comprising the steps of:

for the purpose of forming the initial part (35) of the new web (34), severing a continuous outer covering of a new reel (30) of the new web, or a continuous outer layer of the new web (34), in a direction of an axis of rotation of the reel such that at least one free leg (38, 39) of the new web (34) is formed; and then gripping the web leg (38, 39) and drawing off the initial part (35) from the new reel (30).

3. The process according to claim 1, further comprising the step of drawing off the initial part (35) of the new web (34) from the new reel (30) through a connecting assembly (40).

4. The process according to claim 1, further comprising the steps of winding up the end part (36), which has been severed from the run-off web (29), onto a run-off reel (28) by rotary movement thereof.

5. The process according to claim 1, wherein the end part (36) of the run-off web (29) is collected by being wound up on a run-off reel (28), said process further comprising the step of conveying the end part and the initial part (35), which has been severed from the new web (34), into a container, the end part (36) of the run-off web (29) being drawn off from the run-off reel (28).

6. The process according to claim 1, wherein a reel core (11) of the run-off web remains on an operating stub (26) serving as an axis of rotation for a run-off reel, said process further comprising the steps of:

drawing off the reel core from the operating stub (26) in the axial direction, and conveying the reel core into a collecting container (62).

7. An apparatus for connecting material webs made of packaging material or the like, namely a new, initial portion (59) of a new web (34), wound on a new reel, to a run-off end (58) of a run-off web (29) wound on a run-off reel, wherein the run-off web (29) and the new web (34) are gripped by clamping parts (49, 50; 51, 52) and the run-off web (29) and new web (34) are severed by a severing cutter (56) for the purpose of forming ends—the run-off end (58) and the new initial portion (59)—which are adapted to be connected to one another by a tape (60), characterized in that the clamping parts (49, 50) and (51, 52) are respectively assigned to the run-off web (29) and the new web (34), are actuatable independently of one another for the purpose of fixing the run-off web (29) and new web (34), respectively, said apparatus comprising:

means for severing the run-off web (29) and the new web (34) one after the other and means for moving the clamping parts with the severed webs into a common plane for the purpose of attaching the tape (60).

8. The apparatus according to claim 7, characterized in that respectively spaced-apart ones of said clamping parts are positioned in mutually offset planes corresponding to movement planes of the run-off web (29) and new web (34), said apparatus comprising means to move the clamping parts (49, 50; 51, 52) with the severed web ends—ran-off end (58), new, initial portion (59)—into a common plane.

9. The apparatus according to claim 7, characterized in that the clamping parts are part of a connecting assembly (40) through which the ran-off web (29) runs continuously, the new web (34), which is to be connected, being drawn off from a new web reel (30), and drawn through the connecting assembly (40), by a web pickup (44) which is movable back and forth.

10. The apparatus according to claim 9, characterized in that the new initial portion (35) of the new web (34), said initial portion being drawn off by the web pickup (44), is transferred to a web conveyor, by means of which a further portion of the new web (34) is drawn off from the new reel (30).

11. Apparatus according to claim 7, characterized in that, for the purpose of forming a free initial part (35) of the new web (34), a continuous covering or outer layer of the new reel (30) is severed in the axial direction so as to form at least one web leg (38, 39) hanging freely in the direction tangential to the new reel (30), the pickup (44) gripping one of the web legs (38, 39) and drawing it off from the new web (34).

12. Apparatus according to claim 7, characterized in that the run-off reel (28) and the new reel (30) are each arranged on a carrying stub, namely on an operating stub (26) and a supply stub (27), respectively, wherein that the operating stubs (26, 27) with run-off reel (28) and new reel (30) are arranged on a common, two-armed reel arm (23, 24) which is rotatable about a central rotary bearing (25), and, in a processing position of the run-off reel (28) or new reel (30), the reel arm (23, 24) is arranged in an obliquely directed position and the reel which is to be processed in each case is oriented downwards.

13. Apparatus according to claim 7, characterized in that clamping parts (51, 52) for the purpose of gripping the new web (34) or the initial part (35) are arranged adjacent to an inlet side of the material webs within the connecting assembly (40), and clamping parts (49, 50) for the purpose of gripping the run-off web (29) are arranged on the side which is assigned to an outlet side of the material webs.

14. Apparatus according to claim 7, characterized in that mutually associated clamping parts (49, 50), on the one hand, and (51, 52), on the other hand, are in operational connection with one another, such that top clamping parts (49, 51) are arranged in a fixed starting position and bottom clamping parts (50, 52) are movable in the direction of the fixed clamping parts (49, 51), by means of a common crank mechanism (95).

15. Apparatus according to claim 14, characterized in that the crank mechanism (95) is connected to a carrier which is movable up and down, and on which a pressure-exerting part (52) is attached directly and which acts, via compression springs (94), on another movable clamping part (52).

16. Apparatus according to claim 7, characterized in that at least in each case one clamping part (49, 51) of the clamping parts which are located opposite one another in pairs is mounted elastically, wherein the clamping parts (50, 52), which are movable by a drive, are movable into abutment against the elastically mounted clamping parts (49, 51) for the purpose of clamping the run-off web (29) and the new web (34), and are movable beyond this point counter to the elastic force.

17. Apparatus according to claim 7, characterized in that the severing cutter (56), for the purpose of severing the webs—run-off web (29) and new web (34)—by being moved upwards from a bottom position, severs first of all the new web (34) and then the run-off web (29).

18. Apparatus according to claim 7, characterized in that at least one pressure-exerting part (51), for the purpose of gripping one web—new web (34)—in a clamping position, is positioned beneath the movement plane of the other web—run-off web (29)—and, once the severing cut has been carried out, is moved into a position above the run-off web (29) and new web (34) and, for returning to a bottom starting position, is moved sideways and then to the bottom starting position.

19. Apparatus according to claim 7, characterized in that the tape (60) is advanced up to the webs—run-off web (29) new web (34)—by a movable tape holder (61), and in that the tape holder (61) has a retaining head (108) on which the tape (60) is retained by suction air, and design, can be is pivotable out of a position in which the retaining head (108) is oriented upwards into a position in which the retaining head (108) is oriented downwards.

20. An apparatus for gripping an initial portion of a new web (34) wound as a new reel, characterized in that a web pickup (44) has a gripper (67), which is movable back and forth, for griping an initial part (35) of the new web (34), wherein the gripper (67) has at least two web-retaining elements (69, 70), into which, when open, is introduced a formed loop (73) of the new web (34) in order to be gripped in a clamping manner; and in that, for the purpose of gripping the new web (34) by the gripper (67), the apparatus comprises means for pushing together sections of the web to form a sideways-directed loop (73) in a region of the retaining elements (69, 70), said retaining elements being located on the gripper (67) for the purpose of gripping the new web (34).

21. An apparatus for gripping a free end of a new material web (34) wound as a reel, said apparatus comprising a web pickup (44) for gripping the material web and having a gripper (67), said web pickup being movable back and forth, and said new web being transported away by a corresponding movement of the gripper (67)

said web pickup comprising means for pushing together a section of the web, thereby forming a sideways-directed loop (73); and means for inserting said loop (73) into a position between two clamping jaws (69, 70) of the gripper (67).

22. The apparatus according to claim 21, wherein the gripper (67) has two movable suckers (74, 75) for gripping the new web (34), said two suckers (74, 75) initially being located at a distance from one another when gripping the new web, said apparatus further comprising means for reducing the distance between the suckers (74, 75) to form said loop (73).

* * * * *